US006681095B1

(12) United States Patent
Tsuda

(10) Patent No.: US 6,681,095 B1
(45) Date of Patent: Jan. 20, 2004

(54) TRANSPARENT COAT LAYER FORMING APPARATUS AND COLOR IMAGE FORMING APPARATUS USING THE SAME

(75) Inventor: Yu Tsuda, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/369,608

(22) Filed: Feb. 21, 2003

(30) Foreign Application Priority Data

Oct. 29, 2002 (JP) ..... 2002-315025

(51) Int. Cl.[7] ..... G03G 15/20; G03G 15/00
(52) U.S. Cl. ..... 399/341; 399/329; 430/97
(58) Field of Search ..... 399/341, 342, 399/121, 299, 312, 320, 329; 430/97

(56) References Cited

U.S. PATENT DOCUMENTS 5,126,221 A 6/1992 Chiba et al.
2002/0167681 A1 * 11/2002 Ide et al. ..... 358/1.9

FOREIGN PATENT DOCUMENTS

JP A 63-259575 10/1988
JP A 3-2765 1/1991
JP A 3-130791 6/1991
JP A 5-142963 6/1993

* cited by examiner

*Primary Examiner*—Joan Pendegrass
(74) *Attorney, Agent, or Firm*—Oliff & Berridge, PLC

(57) ABSTRACT

A transparent coat layer forming apparatus of the present invention includes: a heat-fixing device provided with a fixing belt; a particle layer forming apparatus for forming a particle layer made of transparent toner on the fixing belt of the heat-fixing device; plural rollers including a transfer roller for stretching a transfer region of the fixing belt to which the particle layer is transferred from the particle layer forming apparatus in a plane shape; and a retract mechanism for retracting the fixing belt stretched inaplane shapeby the plural rollers including the transfer roller from the particle layer forming apparatus, wherein the particle layer is formed on the fixing belt by the particle layer forming apparatus, and the particle layer formed on the fixing belt of the heat-fixing device is overlapped with a transfer material with an image transferred thereto in a fixing nip portion, followed by heating and pressurizing, whereby a transparent coat layer made of the particle layer is formed on the transfer material with the image transferred thereto.

19 Claims, 11 Drawing Sheets

Fig. 8

| | CONTAMI NATION OF BELT | CHANGE IN SPEED DUE TO ENDS OF RECORDING SHEET | STICK-SLIP | SLIP OF PHOTO SENSITIVE ROLLER | RETRACT | TIMING CONTROL | SAME SPEED | CHANGE ABSORPTION |
|---|---|---|---|---|---|---|---|---|
| EMBODIMENT 1 | ○ | × | × | × | YES | NO | NO | NO |
| EMBODIMENT 2 | ○ | ○ | × | × | YES | YES | NO | NO |
| EMBODIMENT 3 | × | × | ○ | × | NO | NO | CO-ROTATED | NO |
| EMBODIMENT 4-1 | × | × | ○ | ○ | NO | NO | CO-ROTATED | 1way |
| EMBODIMENT 4-2 | × | × | ○ | △ | NO | NO | CO-ROTATED | ELECTROMAGNETIC CLUTCH |
| EMBODIMENT 4-3 | × | △ | ○ | × | NO | NO | CO-ROTATEL | LIMITER |
| EMBODIMENT 5 | ○ | ○ | ○ | ○ | YES | YES | CO-ROTATEL | 1way |
| COMPARATIVE EXAMPLE 1 | × | × | × | × | NO | NO | NO | NO |
| | | | | | | | | |

TRANSPARENT COAT LAYER FORMING APPARATUS AND COLOR IMAGE FORMING APPARATUS USING THE SAME

FIELD OF THE INVENTION AND RELATED ART STATEMENT

The present invention relates to a transparent coat layer forming apparatus for forming a transparent coat layer made of transparent toner on a surface of a color image formed by a copying machine or a printer adopting an electrophotographic system, an electrostatic recording system, and the like, or an image forming apparatus such as a facsimile, and a color image forming apparatus using the transparent coat layer forming apparatus.

Conventionally, in the case where a color image is formed on a transfer material in a copying machine or a printer adopting an electrophotographic system, an electrostatic recording system, and the like, or an image forming apparatus such as a facsimile, a color original is copied, for example, as follows. In the image forming apparatus, a color original is set on a color scanner, the color original is illuminated with light, and light reflected from the color original is split to three colors (e.g., RGB) by the color scanner and read. Image data of the color original read by the color scanner is subjected to predetermined image processing by an image processing device. Thereafter, an image signal of plural colors (e.g., Y (yellow), M (magenta), C (cyan), and K (black)) obtained by color correction is sent to an image exposure device on a color basis. Then, in the image forming apparatus, the image is exposed to light based on the image signal of plural colors sent from the image processing device by the image exposure device. In the image exposure device, for example, a laser light source such as a semiconductor laser is modulated, and a laser beam modulated based on the image signal is emitted from the semiconductor laser. The laser beam is irradiated onto an inorganic photosensitive member such as Se and amorphous silicon or an organic photosensitive member using a phthalocyanine pigment, a bis-azo pigment, or the like as a charge generating layer in plural times for each color. Consequently, plural electrostatic latent images are successively formed for each color on a photosensitive drum made of an inorganic photosensitive member or an organic photosensitive member, every time the photosensitive drum is rotated. The plural electrostatic latent images successively formed on the photosensitive drum are successively developed, for example, with toner of four colors (Y, M, C, and K). The first electrostatic latent image is Y, the second electrostatic latent image is M, and the like. Then, the toner images of the respective colors (Y, M, C, and K) successively formed on the photosensitive drum are finally transferred together in an overlapped state onto a transfer material such as a sheet. Thereafter, the toner images of the respective colors transferred together in an overlapped state onto the transfer material are pressurized by heating to be fixed onto the transfer material with a heat-fixing roller or the like. Thus, a color image is formed.

The color toner used in the above-mentioned image forming apparatus is composed of particles containing, for example, binding resin (e.g., polyester resin, an ethylene/acrylic copolymer, and a styrene/butadiene copolymer) in which a colorant is dispersed, and having an average particle size of 1 to 15 $\mu$m. Fine particles having an average particle size of about 5 to 100 nm (e.g., inorganic fine particles such as silicon oxide, titanium oxide, and aluminum oxide or resin fine particles such as PMMA and PVDF) adhere to the particles of the color toner. Examples of the above-mentioned colorant will be given below. As the Y (yellow) colorant, for example, benzidine yellow, quinoline yellow, Hansa yellow, and the like are used. As the M (magenta) colorant, rhodamine B, rose Bengal, pigment red, and the like are used. As the C (cyan) colorant, phthalocyanine blue, aniline blue, pigment blue, and the like are used. As the K (black) colorant, carbon black, aniline black, a blend of color pigments, and the like are used.

A color image made of the color toner thus formed has its surface fixed and smoothed by heating when being nipped between a heating roller and a pressurizing roller. Therefore, the color image has glossiness different from that of the surface of a sheet. Furthermore, the viscosity of the color toner is varied during fixing by heating, depending upon the kind of binding resin, a method for fixing by heating, and the like. Thus, it is known that the glossiness of a color image is varied.

The preference for the glossiness of a color image is varied depending upon the kind of an image, the purpose of use, and the like. However, in the case of a photographic original of a person, a scene, or the like, an image with high glossiness is preferred so as to obtain a clear image.

As a technique of obtaining an image with high glossiness by using an image forming apparatus such as a color copying machine, for example, those which are disclosed in JP 5-142963 A, JP 3-2765 A, JP63-259575A, and the like have already been proposed. According to the techniques disclosed in these publications, it is attempted to obtain an image with high glossiness by selecting the material for toner, fixing conditions thereof, and the like.

In the case of the techniques disclosed in these publications, although the glossiness of an image part made of toner can be enhanced, the glossiness of a non-image part composed of a surface of a transfer material cannot be enhanced. Therefore, these techniques have a problem that the glossiness of the surface of a transfer material cannot be enhanced and made uniform. Furthermore, in the case of the, techniques disclosed in the above publications, in an image part made of color toner, the layer thickness of a color toner image is varied depending upon the number of colors of color toner forming the image part. Therefore, the unevenness caused by the difference in layer thickness of a toner image remains on the surface of an image, which prevents the surface of an image from being smooth as in a photograph or printed matter and makes it impossible to obtain smooth texture.

In order to solve the above-mentioned problem, the technique disclosed in JP 3-130791 A has already been proposed. According to the technique disclosed in JP 3-130791 A, a transparent resin layer is formed on a fixing belt, and the transparent resin layer is overlapped to be fixed to a transfer material with a toner image adhering thereto, whereby the glossiness on the transfer material is made uniform.

However, the above-mentioned conventional technique has the following problem. That is, in the case of the conventional technique disclosed in JP 3-130791 A, transparent resin is developed on a photosensitive drum in a contact portion between an apparatus for forming a transparent resin layer and a fixing belt at start-up of an apparatus. The development of the transparent resin on the photosensitive drum is caused by the difference between the charge potential of the photosensitive drum at start-up of an apparatus and the potential of a DC bias of a developing device as shown in FIG. 9. Furthermore, if the transparent resin is developed on the photosensitive drum at start-up of an apparatus, i.e., in the absence of a transfer material, the transparent resin developed on the photosensitive drum is transferred to and accumulated on the fixing belt to some degree due to the absence of the transfer material. As a result, the transparent resin accumulated on the fixing belt is diffused on its periphery to adhere to the reverse surface of a recording sheet and contaminates it. Furthermore, the transparent resin accumulated on the fixing belt is transferred to the surface of the recording sheet in some cases, thereby causing a step or a difference in glossiness.

In order to solve the above-mentioned problem, the inventors of the present invention have studied a configuration in which a photosensitive drum 100 used for forming a transparent resin layer and a fixing belt 101 are retracted from each other while an image is not being formed, as shown in FIG. 10.

However, in the case where the photosensitive drum 100 and the fixing belt 101 are retracted while an image is not being formed as described above, another problem occurs this time as follows. That is, it has been found that due to influences of the very high belt tension (i.e., about 10 kg·f) for stretching the fixing belt 101, the occurrence of meandering while running the fixing belt 101, and the change in speed of the fixing belt 101 caused by fixing at a very high pressure, the contact between the photosensitive drum 100 and the fixing drum 101 becomes unstable. This prevents the transparent resin layer from being formed on the fixing belt 101 uniformly, and prevents an image with uniform and high glossiness from being formed.

Furthermore, when the leading edge and the trailing edge of a recording sheet 102 pass through the inlet/outlet of a fixing nip portion between fixing rollers 103 and 104, the speed of the fixing belt 101 is fluctuated. This prevents a uniform transparent resin layer from being formed. Furthermore, when the fixing belt 101 and the photosensitive drum 100 for forming a transparent resin layer are driven by separate driving devices, the difference in driving speed necessarily occurs between the belt driving device and the transparent resin layer forming apparatus, as shown in FIG. 11. Due to the difference in driving speed, the fixing belt 101 and the photosensitive drum 100 are subjected to stick-slip, making it impossible to form a transparent resin layer stably. Herein, the term "stick-slip" refers to a phenomenon in which the fixing belt is repeatedly deformed minutely and slips. The reason for this is considered as follows. The difference in driving speed between the belt driving device and the transparent resin layer forming apparatus causes a difference in speed between the fixing belt 101 and the photosensitive drum 100. When the difference in speed is caused therebetween, the fixing belt 101 made of an elastic member is deformed elastically. When the elastic deformation force of the fixing belt 101 exceeds the frictional force between the fixing belt 101 and the photosensitive drum 100, the fixing belt 101 slides to slip, whereby the elastic deformation force is removed. Then, due to the difference in speed therebetween, the phenomenon of elastic deformation of the fixing belt 101 is repeated again, whereby "stick-slip" occurs.

Furthermore, when the recording sheet 102 passes through the inlet/outlet of the fixing nip portion, the speed of the fixing belt 101 is fluctuated. Therefore, while the recording sheet 102 is passing through the fixing nip portion, an image at the next page cannot be formed. As a result, a transparent resin layer cannot be formed at a high speed.

It is also considered that, in order to reduce the difference in driving speed between the belt driving device and the transparent resin layer forming apparatus, the transparent resin layer forming apparatus is driven so as to co-rotate with (follow) the fixing belt. However, in such a case, as shown in FIG. 12, the frictional force between the fixing belt 101 and the photosensitive drum 100 is varied, depending upon the area of the transparent resin layer formed on the fixing belt 101. Then, the driving of the transparent resin layer forming apparatus including the photosensitive drum 100, following the fixing belt, becomes unstable, making it impossible to form a transparent resin layer uniformly as another problem.

In order to overcome the above-mentioned problem, it is required to decrease a fixing pressure and a speed, and perform driving control with high performance, which causes other problems such as enlargement of an apparatus and a decrease in productivity.

OBJECT AND SUMMARY OF THE INVENTION

The present invention has been made in view of the above circumstances and provides a transparent coat layer forming apparatus capable of allowing the entire surface of an image to be smooth and uniformly providing high glossiness to a transfer material irrespective of an image density without causing an enlargement of an apparatus and a decrease in productivity, and a color image forming apparatus using the transparent coat layer forming apparatus.

In order to attain this, the present invention provides a transparent coat layer forming apparatus, including:

a heat-fixing device provided with a fixing belt;

a particle layer forming apparatus that forms a particle layer made of transparent toner on the fixing belt of the heat-fixing device;

plural rollers including a transfer roller which stretches a transfer region of the fixing belt to which the particle layer is transferred from the particle layer forming apparatus in a plane shape; and a retract mechanism that allows the fixing belt stretched in a plane shape by the plural rollers including the transfer roller to contact/separate from the particle layer forming apparatus, in which the particle layer is formed on the fixing belt by the particle layer forming apparatus, and the particle layer formed on the fixing belt of the heat-fixing device is overlapped with a transfer material with an image transferred thereto in a fixing nip portion, followed by heating and pressurizing, whereby a transparent coat layer made of the particle layer is formed on the transfer material with the image transferred thereto.

The particle layer forming apparatus to be used may be provided with a photosensitive drum, for example.

Furthermore, in the transparent coat layer forming apparatus of the present invention, for example, a speed unevenness absorbing unit is provided, which absorbs a speed unevenness of at least one of the heat-fixing device and the particle layer forming apparatus.

In the transparent coat layer forming apparatus according to the present invention, the speed unevenness absorbing unit includes a unit that is, for example, composed of a one-way gear configuration that is placed in a driving force transmission path of the driving device for the particle layer forming apparatus, is rotated in one direction without a load and locked in rotating in the other direction to transmit a rotation force, is adapted to drive the driving device for the particle layer forming apparatus at a speed slightly lower than that of the fixing belt of the heat-fixing device, is rotated during a normal operation freely without a load to thereby drive the particle layer forming apparatus following the fixing belt, and is locked to transmit the driving force from the driving device to the particle layer forming apparatus when the speed of the particle layer forming apparatus is decreased (in an abnormal state).

Further, in the transparent coat layer forming apparatus according to the present invention, the speed unevenness absorbing unit to be used includes, for example: a detection device that detects a speed of the particle layer forming apparatus; a judging device that judges abnormality based on a detection result of the detection device; and an electromagnetic clutch placed in the driving force transmission path of the driving device for the particle layer forming apparatus, in which the driving force from the driving device for the particle layer forming apparatus is ON/OFF controlled by the electromagnetic clutch in accordance with a judgement signal from the judging device, whereby the driving force is transmitted to the particle layer forming apparatus.

Further, in the transparent coat layer forming apparatus according to the present invention, the speed unevenness absorbing unit to be used includes, for example, a clutch that brakes rotation at a predetermined speed or more placed in the driving device for the particle layer forming apparatus or the heat-fixing device, thereby decreasing change in speed.

Further, a color image forming apparatus according to the present invention includes:

an image bearing member;

a colored toner developing device that forms insulating colored toner images of at least cyan, magenta, and yellow on the image bearing member;

an intermediate transfer member to which the colored toner images are transferred from the image bearing member;

a first transfer device that transfers the colored toner images from the image bearing member onto the intermediate transfer member;

a second transfer device that transfers the colored toner images on the intermediate transfer member onto a transfer material;

a heat-fixing device having a fixing belt which fixes the colored toner images on the transfer material by heating;

a particle layer forming apparatus that forms a particle layer made of transparent toner on the fixing belt of the heat-fixing device;

plural rollers including a transfer roller which stretches in a plane shape a transfer region of the fixing belt to which the particle layer is transferred from the particle layer forming apparatus; and a retract mechanism that allows the fixing belt stretched in a plane shape by the plural rollers including the transfer roller to contact/separate from the particle layer forming apparatus, in which the particle layer is formed on the fixing belt by the particle layer forming apparatus, and the particle layer formed on the fixing belt of the heat-fixing device is overlapped with a transfer material with the colored toner images transferred thereto, followed by heating and pressurizing, whereby a transparent coat layer made of the particle layer is formed on the transfer material with the colored toner images transferred thereto.

Then, in the color image forming apparatus according to the present invention, the particle layer forming apparatus and the fixing belt of the heat-fixing device are driven as described above for instance.

According to the present invention, the above-mentioned configuration includes basically plural rollers including a transfer roller which stretches in a plane shape a transfer region of a fixing belt to which a particle layer is transferred from the particle layer forming apparatus and a retract mechanism that allows the fixing belt stretched in a plane shape by the plural rollers including the transfer roller to contact/separate from the particle layer forming apparatus. Because of this, while the particle layer forming apparatus is exactly in contact with the fixing belt by the plural rollers including the transfer roller for stretching the fixing belt in a plane shape, the particle layer forming apparatus is retracted from the fixing belt when this contact is not necessary. Thus, it is possible to provide a transparent coat layer forming apparatus capable of allowing the entire surface of an image to be smooth and providing high glossiness to a transfer material irrespective of an image density without causing an enlargement of an apparatus and a decrease in productivity, and a color image forming apparatus using the transparent coat layer forming apparatus.

These and other advantages of the present invention will become apparent to those skilled in the art upon reading and understanding the following detailed description with reference to the accompanying figures.

BRIEF DESCRIPTION OF THE DRAWINGS

Preferred embodiments of the present invention will be described in detail based on the following figures, wherein:

FIG. 8 is a table showing evaluation results of Embodiments 1 to 5 and a comparative example;

DETAILED DESCRIPTION OF THE PREFERRED EMBODIMENT

Hereinafter, the present invention will be described by way of illustrative embodiment modes with reference to the drawings.

Embodiment Mode 1

Figure 1:
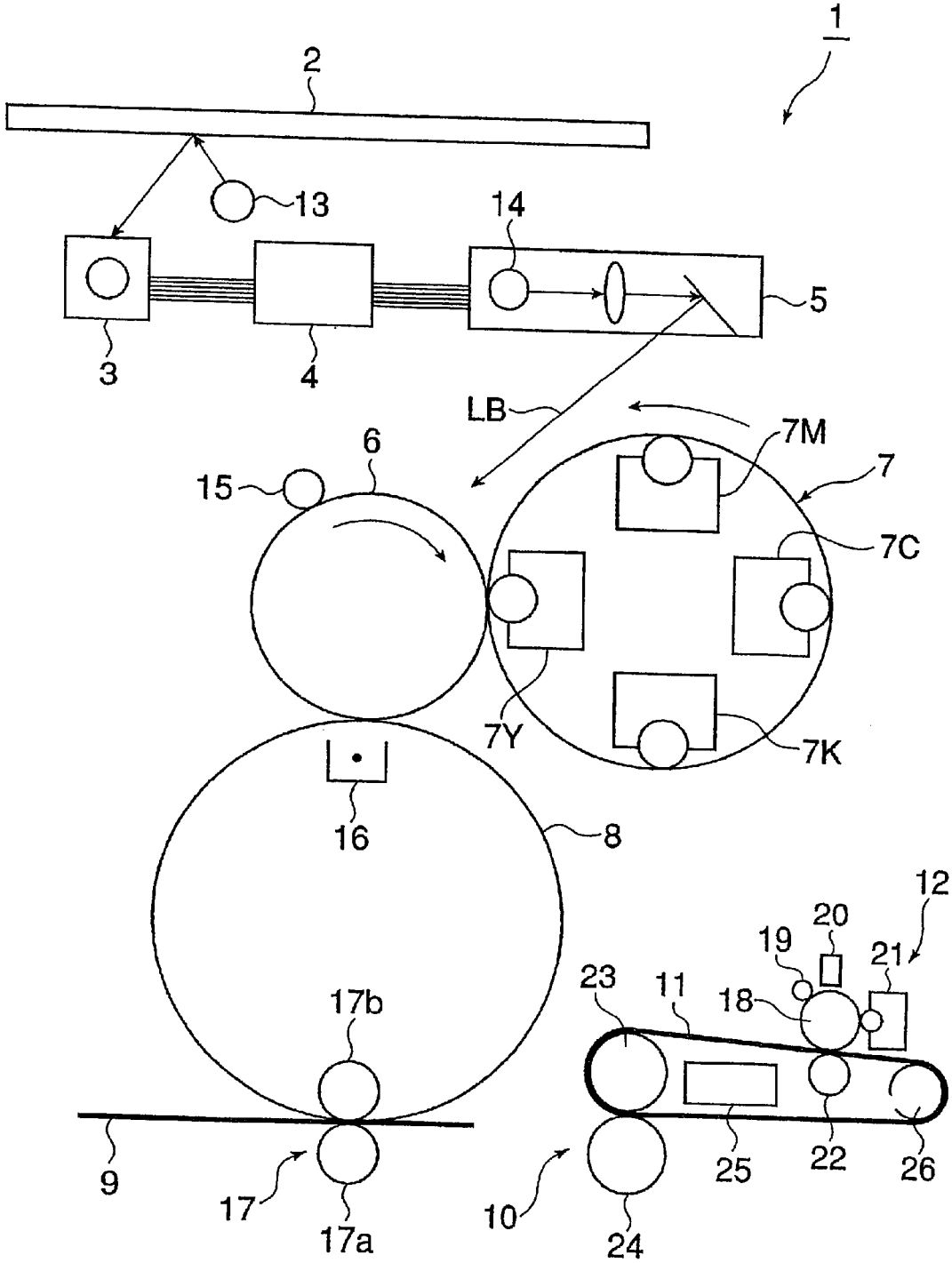
FIG. 1 is a structural view showing a color image forming apparatus to which a transparent coat layer forming apparatus in accordance with Embodiment Mode 1 of the present invention is applied.

FIG. 1 is a view showing a configuration of a color image forming apparatus incorporating a transparent coat layer forming apparatus of Embodiment Mode 1 according to the present invention.

As shown in FIG. 1, the color image forming apparatus 1 mainly includes a color scanner 3 as an image reading device for reading an image of a color original 2; an image processing device 4 for subjecting the image date read by the color scanner 3 to predetermined image processing; a ROS 5 as an image exposure device for exposing an image in accordance with the image data of corresponding color subjected to the predetermined image processing by the image processing device 4; a photosensitive drum 6 as an image bearing member which is subjected to image exposing by the ROS 5 and on which an electrostatic latent image is formed; a rotary colored toner developing device 7 provided with plural developing units for developing the electrostatic latent image formed on the photosensitive drum 6 with color toner of corresponding color; an intermediate transfer member 8 on which toner images formed on the photosensitive drum 6 are successively transferred in an overlapped state; a heat-fixing device 10 having a fixing belt 11 for fixing the toner images onto a transfer material 9 on which toner images with a predetermined number of colors have been transferred together from the intermediate transfer member 8; and a particle layer forming apparatus 12 for forming a particle layer made of transparent toner on the fixing belt 11 of the heat-fixing device 10. In FIG. 1, the heat-fixing device 10 and the particle layer forming apparatus 12 are shown schematically under the condition that rollers are omitted partially.

The above-mentioned color scanner 3 as the image reading device illuminates the image of the color original 2 placed on a platen glass (not shown) by a light source 13. Furthermore, the color scanner 3 scans a light image reflected from the color original 2 and exposes a color image reading element composed of a CCD or the like (not shown) to the light image via plural mirrors such as a full-rate mirror and a half-rate mirror and an image-forming lens (not shown). Then, the color scanner 3 allows the color image reading element to read the image of the color original 2 as an image signal of RGB.

Furthermore, the image signal of the color original 2 output from the color scanner 3 is input to the image processing device 4. Then, the image signal is subjected to predetermined image processing by the image processing device 4, and sent to the ROS 5 as an image exposure device. The ROS 5 is provided with a laser diode 14 that is modulated in accordance with the image signal. A laser beam LB modulated in accordance with the image signal is emitted from the laser diode 14. The laser beam LB is scanned and the photosensitive drum 6 is exposed to the laser beam LB via a scanning optical system composed of a f-θ lens, a polygon mirror, or the like.

Prior to the image exposure by the ROS 5, the surface of the photosensitive drum 6 is charged uniformly with a predetermined potential by a charger 15 such as a charging roller, a scorotron charger, or the like. Thereafter, the surface of the photosensitive drum 6 is successively exposed to images of the respective colors corresponding to yellow, magenta, cyan, and black by the ROS 5. Then, electrostatic latent images of the corresponding colors are successively formed on the surface of the photosensitive drum 6.

Herein, there is no particular limit to the above-mentioned photosensitive drum 6 as an electrophotographic photoreceptor. Known photosensitive members can be used. The photosensitive drum 6 may have a single layer structure or a multi-layer structure of a function separation type. Furthermore, as the material for the electrophotographic photoreceptor, an inorganic material such as Se and amorphous silicon or an organic material may be used.

Then, the electrostatic latent images formed on the photosensitive drum 6 are developed by developing units 7Y, 7M, 7C, and 7K of corresponding colors of the rotary colored toner developing device 7. The colored toner developing device 7 includes the developing units 7Y, 7M, 7C, and 7K of the respective colors (yellow, magenta, cyan, and black) in a peripheral direction. The colored toner developing device 7 develops insulating colored toner on the photosensitive drum 6 to form a toner image. Herein, the colored toner includes black toner. As long as this purpose is satisfied, any known developing device can be used as the colored toner developing device 7. An example of the respective developing units 7Y, 7M, 7C, and 7K of the colored toner developing device 7 includes a known developing unit having a function of allowing toner to adhere to the photosensitive drum 6 by using a brush, a roller, and the like. Furthermore, a developing unit is known, which forms a color image on a photosensitive drum by using charged colored toner mixed with a known carrier. As such a developing unit, for example, a known apparatus as described in JP 63-58374 A can be used. A developing unit using one-component developer without using a carrier may be adopted.

Furthermore, the colored toner images of respective colors (yellow, magenta, cyan, and black) successively formed on the photosensitive drum 6 are successively transferred in an overlapped state to the intermediate transfer member 8 formed in a drum shape or a belt shape by a first transfer device 16. Thus, the colored toner images formed on the photosensitive drum 6 are successively transferred to the intermediate transfer member 8. When the surface of the intermediate transfer member 8 is charged uniformly so as to have a surface potential of 500 V, it is required that the potential half-life is in a range of 0.05 to 1.0 seconds. In the case where the potential half-life is shorter than 0.05 seconds, colored toner images cannot be transferred uniformly to the intermediate transfer member 8 by the first transfer device 16, or colored toner images cannot be transferred uniformly to the transfer material 9 by a second transfer device 17. Furthermore, if the above-mentioned half-life is satisfied, a known intermediate transfer member 8 can be used.

Furthermore, the intermediate transfer member 8 with its half-life adjusted as described above can be obtained, for example, by dispersing conductive inorganic powder such as conductive carbon, a conductive polymer such as polyaniline, and the like in a dielectric material such as polyimide. Herein, the half-life is defined as follows. First, the reverse surface of the intermediate transfer member 8 is grounded, and the front surface thereof is charged so as to have an initial potential of −500 V by a charge scorotron. The intermediate transfer member 8 is moved just under an electrometer within 0.05 seconds to measure a decrease in potential. Then, a time (including a movement time of 0.05 seconds) at which the charge potential of the intermediate transfer member 8 becomes a half (i.e., −250 V) is defined as a half-life.

Furthermore, as the first transfer device 16, for example, a conductive or semi-conductive roller, brush, film, rubber blade or the like with a voltage applied thereto can be used. The first transfer device 16 forms an electric field between the photosensitive drum 6 and the intermediate transfer member 8, and transfers charged toner particles. Furthermore, as the first transfer device 16, those which are composed of a corotron charger, scorotron charger, or the like using corona discharge can be used. The first transfer device 16 subjects the reverse surface of the intermediate transfer member 8 to corona charging and transfers charged toner particles.

Furthermore, as the second transfer device 17 for transferring the color toner on the intermediate transfer member 8 to the transfer material 9, a known transfer device can be used. For example, those which are composed of a pair of conductive or semi-conductive rollers 17*a* and 17*b* and the like with a voltage applied thereto can be used. The second transfer device 17 forms an electric field between the intermediate transfer member 8 and the transfer material 9 and transfers charged toner particles. Furthermore, the second transfer device 17 may be provided with a counter electrode on a corotron charger, scorotron charger, and the like placed on the reverse surface of the intermediate transfer member 8 or the reverse surface of the transfer material 9. The second transfer device 17 subjects the reverse surface of the intermediate transfer member 8 or the reverse surface of the transfer material 9 to corona charging, and transfer charged toner particles.

The transfer material 9 with the colored toner images transferred thereto as described above is transported to the heat-fixing device 10. The colored toner images and transparent toner images are fixed to the transfer material 9 with its surface coated with the transparent toner image by heat and pressure with the heat-fixing device 10.

Figure 2:
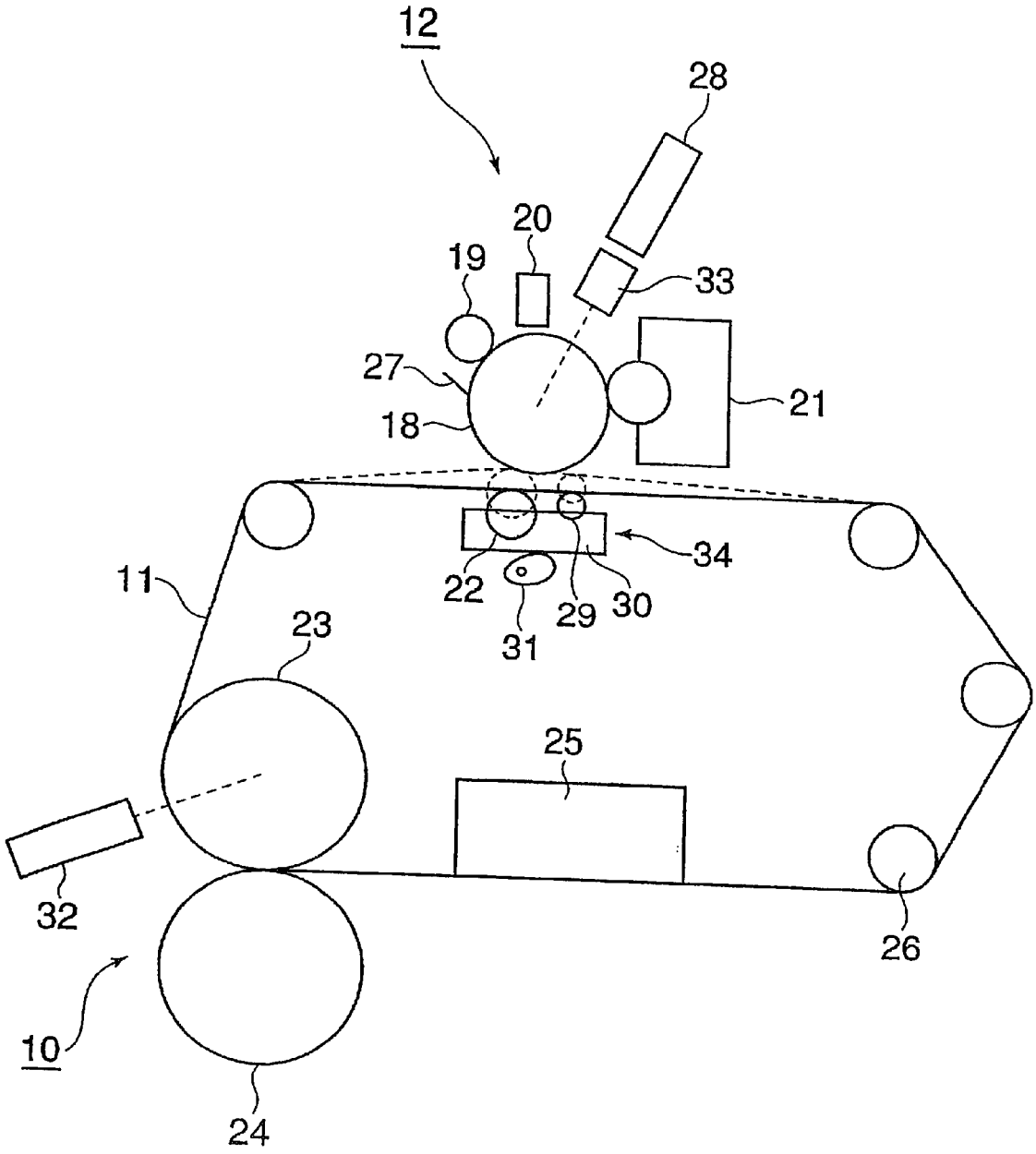
FIG. 2 is a structural view showing the transparent coat layer forming apparatus in accordance with Embodiment Mode 1 of the present invention.

A transparent coat layer forming apparatus of this embodiment mode includes the heat-fixing device 10 provided with the fixing belt 11 and the particle layer forming apparatus 12 for forming a particle layer made of transparent toner on the fixing belt 11 of the heat-fixing device 10. As the particle layer forming apparatus 12, for example, a particle layer developing device for developing a particle layer electrostatically with respect to the fixing belt 11. However, as the particle layer forming apparatus 12, since a particle layer can be formed selectively on the fixing belt 11, the following is desirably used. The particle layer forming apparatus 12 is composed of an image forming apparatus for forming a particle layer provided with a photosensitive drum 18, as shown in FIGS. 1 and 2. The particle layer forming apparatus 12 transfers a particle layer made of transparent toner formed on the photosensitive drum 18 to the fixing belt 11, thereby forming a particle layer.

The image forming apparatus 12 for forming a particle layer includes the photosensitive drum 18, and uniformly charges the surface of the photosensitive drum 18 to a predetermined potential by a charging unit 19 such as a charging roller, as shown in FIG. 2. Thereafter, the surface of the photosensitive drum 18 is exposed to light in accordance with image information of a transparent toner image by an image exposure device 20, whereby an electrostatic latent image is formed on the surface of the photosensitive drum 18. As the image exposure device 20, a known exposure device can be used. However, as the image exposure device 20, an led array (light-emitting diode element) is desirably used in terms of miniaturization of an apparatus. Furthermore, as the particle layer developing device 21 for developing a particle layer with respect to the photosensitive drum 18, a known two-component developing device or one-component developing device can be used. However, as the particle layer developing device 21, a one-component developing device of non-contact type is preferably used in terms of the absence of influence by the carrier movement to the fixing belt 11.

The transparent toner image formed on the photosensitive drum 18 is transferred to the fixing belt 11 by a transfer roller 22 as a transfer unit.

Furthermore, as the heat-fixing device 10, for example, a heat-roller fixing unit is used, which deforms toner by melting and fixes it, using a heating roller 23 and a pressurizing roller 24. The heat-fixing device 10 includes the fixing belt 11. The heat-fixing device 10 fixes a color toner image formed on the transfer material 9 under the condition that the color toner image is overlapped with a particle layer on the fixing belt 11. Furthermore, in order to obtain a smooth image surface structure, it is preferable that the heat-fixing device 10 includes heating/pressurizing units 23, 24 and a cool-peeling device 25. The heating/pressurizing units 23 and 24 melt the color toner image on the transfer material 9 and the particle layer image made of transparent toner on the fixing belt 11 by heating in a range of 110° C. to 200° C. under the condition that they are in contact with each other. The particle layer image made of transparent toner is formed, for example, over the substantially entire surface of the transfer material 9. However, the particle layer image made of transparent toner may be formed only in a region of a particular color toner image on the transfer material 9. On the other hand, the cool-peeling device 25 cools the transfer material 9, for example, in a range of 50° C. to 95°, and then, peels the color toner image and the particle layer image on the transfer material 9 and the fixing belt 11. Note that the heating roller 23 and the pressurizing roller 24 both include a heat source (not shown) therein so as to heat a fixing nip to the above-mentioned heating temperature.

In terms of a peeling property, it is preferable that the surface of the fixing belt 11 is coated with silicon resin and/or fluorine resin. Furthermore, in terms of smoothness, it is preferable that the surface of the fixing belt 11 has a glossiness of 60 degrees or more when measured by a 75 degree glossmeter.

Furthermore, as the cool-peeling device 25, in terms of the size of an apparatus, it is preferable to use a unit for increasing a cooling speed by using a heat sink or a heat pipe. It is also preferable that a peeling hook is inserted between the fixing belt 11 and the transfer material 9, or a peeling roller 26 with a small curvature is provided at a peeling position, whereby peeling is performed by the stiffness of the transfer material 9.

The fixing belt 11 is stretched, for example, between the heating roller 23 and the peeling roller 26 at a high tension of about 10 kg·f. The fixing belt 11 may be stretched via another roller, as shown in FIG. 2.

In the particle layer developing device 21, transparent toner is used so as to form a transparent toner image. The transparent toner contains at least binding resin.

According to the present invention, the term "transparent toner" refers to toner particles containing no color material (coloring pigment, coloring dye, black carbon particles, black magnetic powder, etc.) for coloring by light absorption or light scattering. The transparent toner in the present invention is generally colorless and transparent. The transparency of the transparent toner may be slightly lowered depending upon the kind and amount of a fluidization agent and a release agent contained therein. However, the transparent toner is substantially colorless and transparent.

The above-mentioned binding resin may be substantially transparent, and can be appropriately selected in accordance with the purpose. Examples of the binding resin include known resin used for general toner such as polyester resin, polystyrene resin, polyacrylic resin, othervinyl resin, polycarbonate resin, polyamide resin, polyimide resin, epoxy resin, and polyurea resin, and polymers thereof. Among them, polyester resin is preferable since it can simultaneously satisfy a low-temperature fixing property, fixing strength, and storage property. Furthermore, considering the use with the heat-roller fixing device, the binding resin is preferably polyester with a weight-average molecular weight of 5000 to 12000.

In order to obtain high glossiness uniformly in the above transparent toner, it is required to control the flowability and the chargeability of toner. In terms of the control of the flowability and the chargeability of the transparent toner, it is preferable that inorganic fine particles and/or resin fine particles are added or allowed to adhere to the surface of the transparent toner.

There is no particular limit to the above-mentioned inorganic fine particles as long as they do not impair the effect of the present invention. The inorganic fine particles can be appropriately selected from known fine particles used as an additive in accordance with the purpose. Examples of the inorganic fine particles include silica, titanium dioxide, tin oxide, and molybdenum oxide. Furthermore, as the inorganic fine particles, considering the stability such as chargeability, those which are made hydrophobic by using a silane coupling agent, titanium coupling agent, or the like can be used.

There is no particular limit to the above-mentioned organic fine particles as long as they do not impair the effect of the present invention. The organic fine particles can be appropriately selected from known fine particles used as an additive in accordance with the purpose. Examples of the organic fine particles include polyester resin, polystyrene resin, polyacrylic resin, vinyl resin, polycarbonate resin, polyamide resin, polyimide resin, epoxy resin, polyurea resin, and fluorine resin.

It is particularly preferable that the average particle size of the inorganic fine particles and the organic fine particles is 0.005 to 1 $\mu$m. The reason for this is as follows. If the average particle size is less than 0.005 $\mu$m, when the inorganic fine particles and/or resin fine particles are allowed to adhere to the surface of the transparent toner, these particles cling together, which may prevent a desired effect from being obtained. On the other hand, if the average particle size exceeds 1 $\mu$m, it becomes difficult to obtain an image with higher glossiness.

It is not particularly required to limit the particle size of the above transparent toner. However, the particle size is desirably in a range of 8 $\mu$m to 20 $\mu$m so as not to disturb colored toner images. In the case where the particle size of the transparent toner is less than 8 $\mu$m, a high electric field needs to be applied between the developing device 21 and the photosensitive drum 18. On the other hand, when the particle size of the transparent toner exceeds 20 $\mu$m, it becomes difficult to form a uniform transparent toner image.

The colored toner used in the colored toner developing device 7 is composed of insulating particles containing at least binding resin and a coloring agent, and examples thereof include cyan toner, magenta toner, yellow toner, black toner, and the like. The composition, average particle size, and the like of the colored toner are appropriately selected from a range that does not impair the object of the present invention.

Examples of the above-mentioned binding resin include those which are exemplified as the binding resin in the transparent toner. Considering the use with the heat-roller fixing device, the binding resin is preferably polyester with a weight-average molecular weight of 5000 to 12000. There is not particular limit to the coloring agent as long as it is generally used for toner. The coloring agent can be selected from a known cyan pigment or dye, magenta pigment or dye, yellow pigment or dye, and black pigment or dye. Preferably, in order to enhance the effect of obtaining high glossiness, it is important to suppress diffused reflection at an interface between the pigment of the coloring agent and the binder. It is effective to use a combination with a coloring agent in which a pigment with a small particle size is highly dispersed, described in JP 4-242752 A.

It is not particularly required to limit the particle size of the colored toner. However, considering the function of the exposure device 5 for reproducing an electrostatic latent image faithfully, the particle size is desirably in a range of 4 $\mu$m to 8 $\mu$m.

In the present invention, the colored toner may be appropriately produced, or may be obtained from the market.

The transparent toner and the colored toner are used after being combined with an appropriately selected known carrier to be formed into a developing agent. The following is also possible: the transparent toner and the colored toner are charged by friction with a developing sleeve or a charging member to form charged toner as one-component developing agent, and the charged toner is applied to development in accordance with an electrostatic latent image.

Incidentally, the transparent coat layer forming apparatus of this embodiment mode includes:

a heat-fixing device provided with a fixing belt;

a particle layer forming apparatus for forming a particle layer made of transparent toner on the fixing belt of the heat-fixing device;

plural rollers including a transfer roller for stretching a transfer region of the fixing belt to which the particle layer is transferred from the particle layer forming apparatus in a plane shape; and a retract mechanism for retracting the fixing belt stretched in a plane shape by the plural rollers including the transfer roller from the particle layer forming apparatus, in which the particle layer is formed on the fixing belt by the particle layer forming apparatus, and the particle layer formed on the fixing belt of the heat-fixing device is overlapped with a transfer material with an image transferred thereto in a fixing nip portion, followed by heating and pressurizing, whereby a transparent coat layer made of the particle layer is formed on the transfer material with the image transferred thereto.

Further, in this embodiment mode, the retract mechanism is controlled so as to retract the fixing belt from the particle layer forming apparatus at least when an end of the transfer material passes through the fixing nip portion of the heat-fixing device.

FIG. 2 shows a further specific configuration of the above-mentioned transparent coat layer forming apparatus.

The transparent coat layer forming apparatus mainly includes the heat-fixing device 10 and the particle layer forming apparatus 12, as shown in FIG. 2. The particle layer forming apparatus 12 includes the photosensitive drum 18 provided on the fixing belt 11, the charging roller 19 as a charging device for uniformly charging the surface of the photosensitive drum 18 to a predetermined potential, the LED array (light-emitting diode element) 20 as an exposure device, the particle layer developing device 21 for developing an electrostatic latent image formed on the photosensitive drum 18 as a particle layer with a transparent toner layer, the transfer device 22 for transferring a transparent toner layer developed on the photosensitive drum 18 to the fixing belt 11, and a cleaner 27 for cleaning the photosensitive drum 18.

The photosensitive drum 18 is rotate data predetermined speed in an arrow direction by a driving device 28 for the particle layer forming apparatus 12, composed of a driving motor, a driving gear, and the like.

Figure 3:
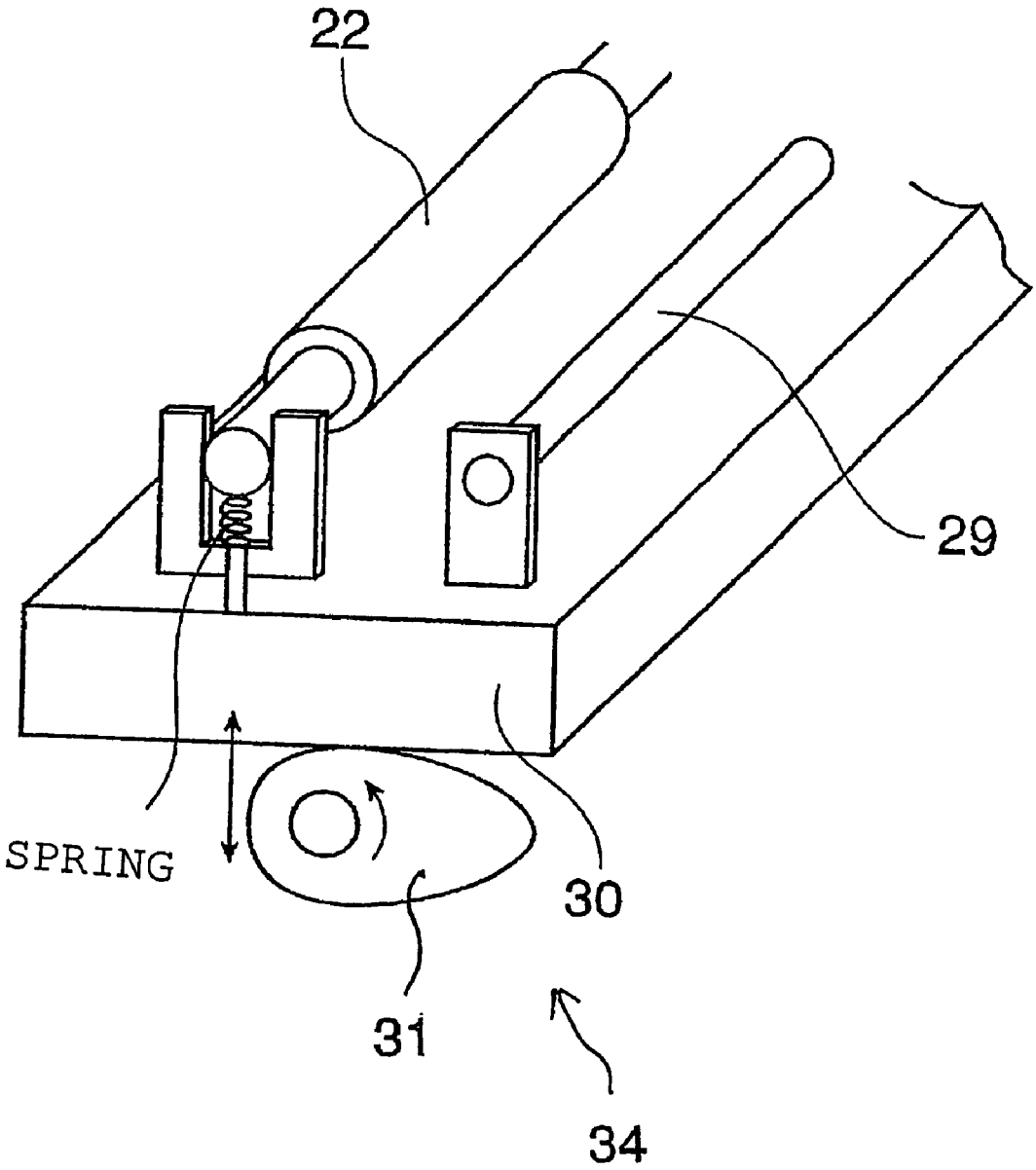
FIG. 3 is a structural view showing a retract mechanism of the transparent coat layer forming apparatus in accordance with Embodiment Mode 1 of the present invention.

The transfer device 22 includes the transfer roller 22 with a large diameter and a guide roller 29 with a small diameter, placed inside of the fixing belt 11 of the heat-fixing device 10, as shown in FIG. 2. The transfer roller 22 and the guide roller 29 stretch a transfer region of the fixing belt 11 in a plane shape. The transfer roller 22 and the guide roller 29 are rotatably attached to a frame base 30, as shown in FIG. 3. The transfer roller 22 and the guide roller 29 are movable in a vertical direction so as to be simultaneously brought into contact with or retracted from the photosensitive drum 18 by a retract mechanism 34 composed of an elliptical cam 31 placed under the frame base 30. As a result, the transfer roller 22 and the guide roller 29 bring the photosensitive drum 18 of the particle layer forming apparatus 12 into contact with or retract it from the fixing belt 11 of the heat-fixing device 10.

A driving device 32 for the heat-fixing device 10 and the driving device 28 for the particle layer forming apparatus 12 are separately configured, as shown in FIG. 2. As the driving device 32 for the heat-fixing device 10, for example, a belt driving device composed of a driving motor and a driving gear for rotating the heating roller 23 to be driven is used. As the driving device 28 for the particle layer forming apparatus 12, for example, a driving device for a particle layer forming apparatus composed of a driving motor and a driving gear for rotating the photosensitive drum 18 is used. Furthermore, a one-way gear 33 is placed, as a speed unevenness absorbing unit, between the photosensitive drum 18 to be driven and the driving device 28 for the particle layer forming apparatus.

The driving speed of the driving device 28 for the particle layer forming apparatus is set slightly lower (3 to 10%) than that of the belt driving device 32. As a result, when the fixing belt 11 comes into contact with the photosensitive drum 18 by the retract mechanism 34, the photosensitive drum 18 is idled by the one-way gear 33. The driving force of the photosensitive drum 18 is supplied to the photosensitive drum 18 via the contact portion of the fixing belt 11, and the photosensitive drum 18 follows the fixing belt 11 to share the same driving force. Because of this, the driving device for the photosensitive drum 18 is switched from the driving device 28 to the driving device 32. When the photosensitive drum 18 slips with respect to the fixing belt 11, and its driving speed becomes low, the driving force from the driving device 28 is supplied to the photosensitive drum 18 by the one-way gear 33 that is also a speed unevenness absorbing unit.

Figure 4:
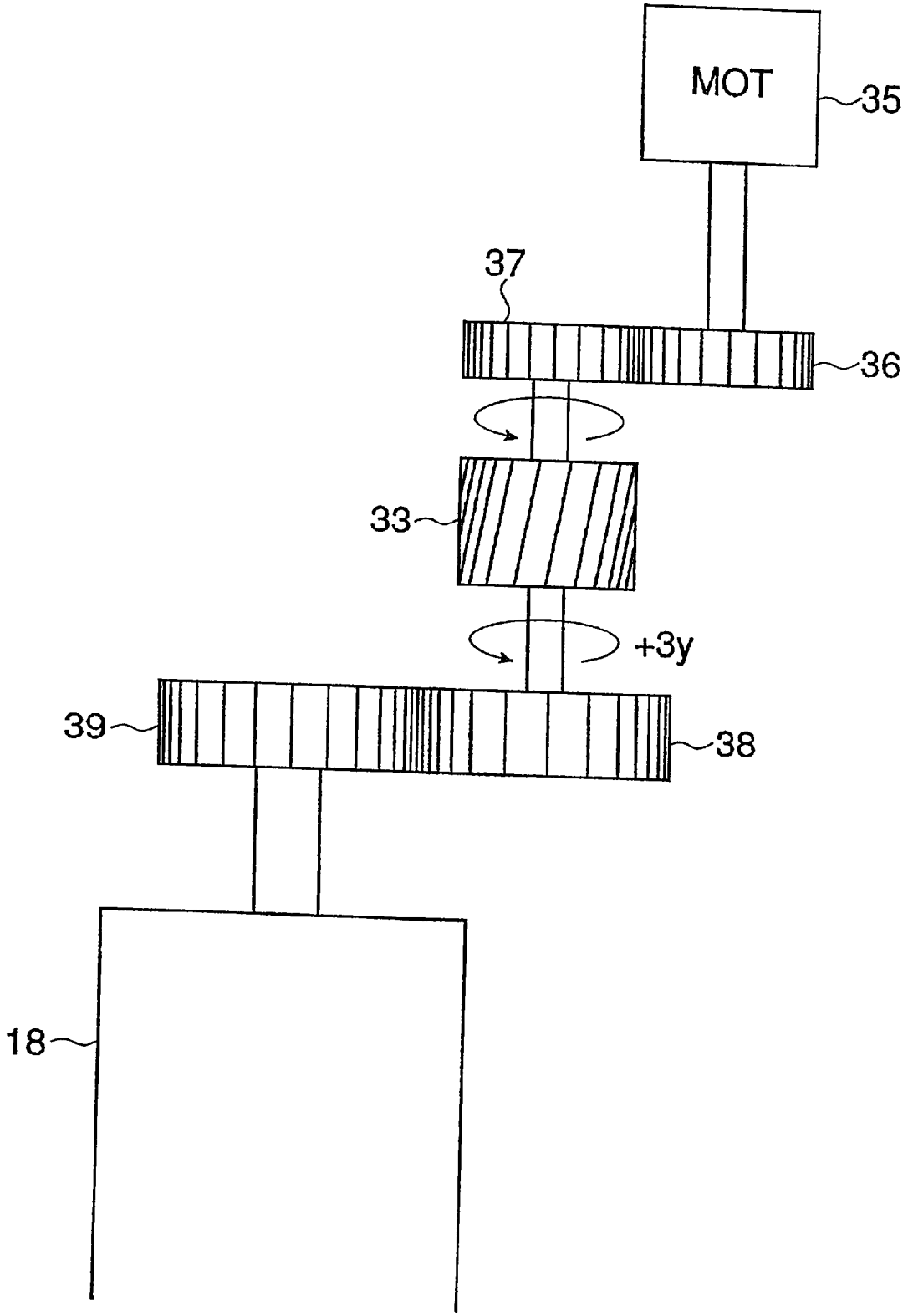
FIG. 4 is a structural view showing a driving device for the transparent coat layer forming apparatus in accordance with Embodiment Mode 1 of the present invention.

More detailed description will be made. The driving device 28 for the particle layer forming apparatus is configured so as to transmit the driving force from a driving motor 35 to the photosensitive drum 18 via plural driving force transmitting gears 36 to 39, as shown in FIG. 4. At this time, the one-way gear 33 is interposed between the driving force transmitting gears 37 and 38. The one-way gear 33 is idled in the case where the rotation speed of the photosensitive drum 18 is higher than that of the driving motor 35. However, when the rotation speed of the photosensitive drum 18 becomes lower than that of the driving motor 35, the one-way gear 33 transmits the rotation driving force to the photosensitive drum 18 so as to drive the photosensitive drum 18 at a predetermined rotation speed.

With the above configuration, in the color image forming apparatus of this embodiment mode, high glossiness can be provided uniformly to a transfer material without enlarging an apparatus or decreasing productivity so that the entire surface of an image is smooth and with out depending upon an image density in the following manner.

In the color image forming apparatus 1 of this embodiment mode, as shown in FIG. 1, a color copy is made as follows. First, the color original 2 to be copied is illuminated with light by the light source 13, and light reflected from the color original 2 is split to colors by the color scanner 3 and read. The read image signal is subjected to predetermined image processing by the image processing device 4. In the image processing device 4, color correction and the like are performed to obtain image data corresponding to colored toner of plural colors. The laser diode 14 is modulated based on the image data of colored toner of plural colors, and the laser beam LB modulated on a color basis is emitted from the laser diode 14. The laser beam LB illuminates the photosensitive drum 6 on a one-by-one color basis (laser beam LB corresponding to yellow, laser beam LB corresponding to magenta, etc.). As a result, plural electrostatic latent images are successively formed on the surface of the photosensitive drum 6. The plural electrostatic latent images are successively developed by the yellow developing unit 7Y, the magenta developing unit 7M, the cyan developing unit 7C, and the black developing unit 7K using colored toner of four colors (yellow, magenta, cyan, and black). The developed color toner images are transferred to the intermediate transfer belt 8 from the photosensitive drum 6 by the transfer corotron 16, whereby the colored toner images of four colors are transferred to the intermediate transfer belt 8 in an overlapped state. Thereafter, the colored toner images of four colors are transferred together from the intermediate transfer belt 8 to the transfer material 9 by the second transfer device 17.

In synchronization with the image forming timing of the color image forming apparatus 1, the photosensitive drum 18 of the particle layer forming apparatus 12 is rotated to be driven by the driving device 28 for the particle layer forming apparatus, as shown in FIG. 2. A transparent toner layer (transparent coat layer) is formed on the photosensitive drum 18 due to the charging by the charging device 19, the exposure by the exposure device 20 in accordance with an image of the color image forming apparatus 1, and the development by the developing device 21.

Next, the retract mechanism 34 is driven, whereby the fixing belt 11 is brought into contact with the surface of the photosensitive drum 18 in a plane shape in a wide range from the transfer roller 22 to the guide roller 29. Before this, the fixing belt 11 has been retracted from the photosensitive drum 18. Then, the transparent toner layer is transferred to the fixing belt 11 by the transfer roller 22. When the fixing belt 11 comes into contact with the photosensitive drum 18 by the retract mechanism 34, the driving of the photosensitive drum 18 is switched to that of the driving device 32 by the one-way gear 33 provided between the photosensitive drum 18 and the driving device 28. As a result, the photosensitive drum 18 follows the fixing belt 11. In the case where the photosensitive drum 18 slips with respect to the fixing belt 11, the one-way gear 33 that also functions as a speed unevenness absorbing unit provides the driving force of the driving device 28 to the photosensitive drum 18. Then, the transparent toner image is always stably transferred from the photosensitive drum 18 to the fixing belt 11.

The transparent toner image formed on the fixing belt 11 is overlapped with the transfer material 9 in the fixing nip portion between the heating roller 23 and the pressurizing roller 24. Then, the transparent toner image is transferred and fixed to the transfer material 9 by the heating roller 23 and the pressurizing roller 24. Thereafter, the transfer material 9 is cooled while being in contact with the fixing belt 11 via the cool-peeling device 25, and peeled from the fixing belt 11 by the peeling roller 26 with a small diameter.

When plural images are formed, the color image forming apparatus 1 is operated as follows. When the end of the transfer material 9 such as a recording sheet discharged from the second transfer device 17 of the color image forming apparatus 1 passes through the fixing nip portion between the heating roller 23 and the pressurizing roller 24, the photosensitive drum 18 and the fixing belt 11 are retracted from each other by the retract mechanism 34. Thus, the above-mentioned process is repeated while controlling the retract mechanism 34, whereby the colored toner images on the transfer material 9 are coated with the transparent toner layer to form an image with uniform glossiness.

More detailed description will be made. The timing for retracting the photosensitive drum 18 and the fixing belt 11 from each other by moving the transfer roller 22 in a vertical direction is set as follows. When the end of the recording sheet 9 having passed through the second transfer device 17 of the color image forming apparatus 1 shown in FIG. 1 passes through the fixing nip portion between the heating roller 23 and the pressurizing roller 24, the photosensitive drum 18 and the fixing belt 11 are always retracted from each other.

Figure 5:
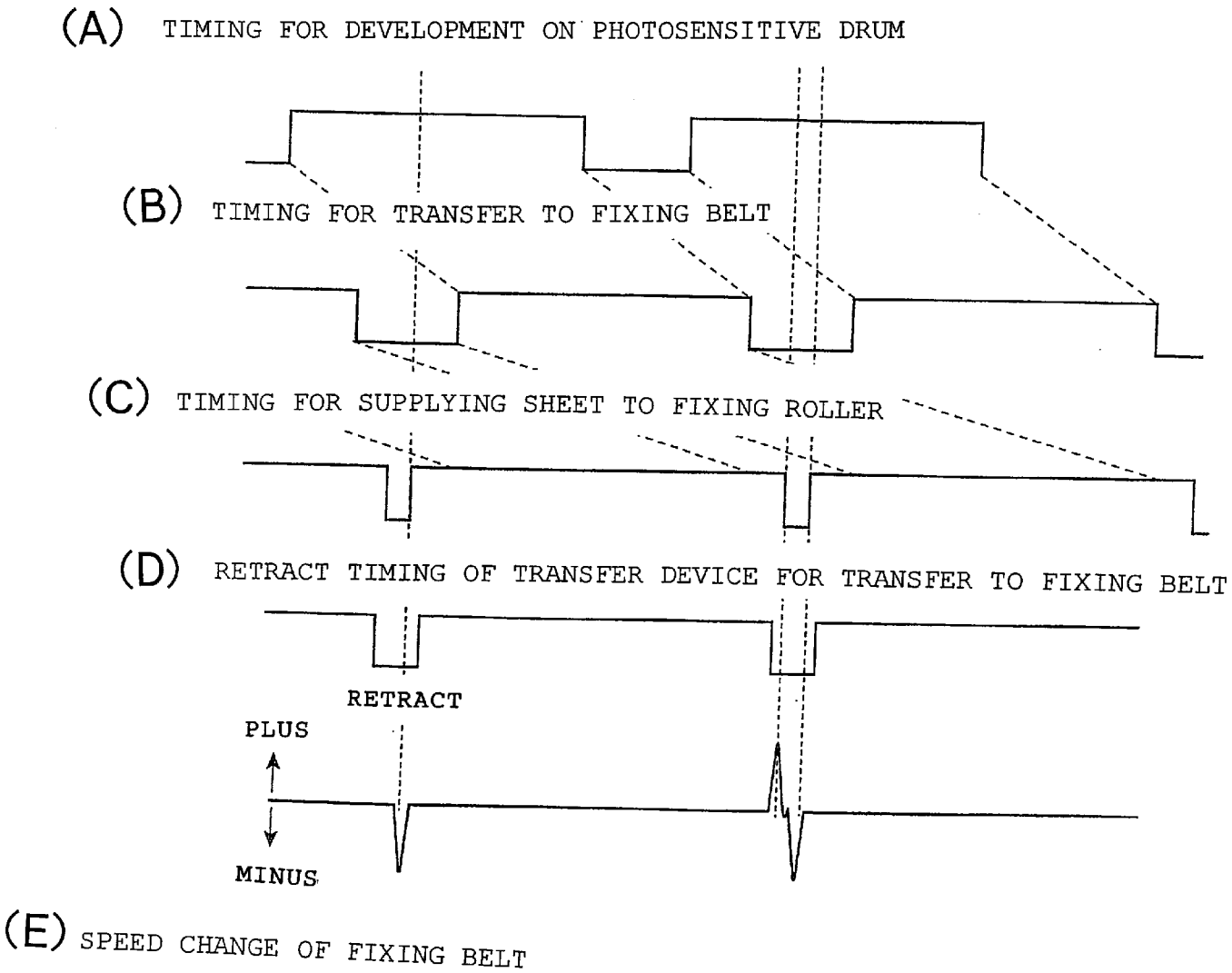
FIG. 5 is a timing chart showing a retract timing of the transparent coat layer forming apparatus in accordance with Embodiment Mode 1 of the present invention.

A specific timing will be described with reference to FIG. 5. FIG. 5 shows a relationship between the formation of a particle layer in the particle layer forming apparatus 12 and the sheet supply timing of the recording sheet 9. In FIG. 5, (a) represents an ON/OFF timing of a development bias for forming a particle layer on the photosensitive drum 18 of the particle layer forming apparatus is by the developing device 21. In FIG. 5, (b) represents an ON/OFF timing of a transfer bias for transfer to the fixing belt 11 by the transfer roller 22. In FIG. 5, (c) represents a sheet supply timing at which the recording sheet 9 having passed through the second transfer device 17 of the color image forming apparatus 1 in FIG. 1 enters the fixing nip portion between the heating roller 23 and the pressurizing roller 24. These timings are shifted by the time of rotation of the photosensitive drum 18 from the developing device 21 to the transfer roller 22 and the time of transportation on the fixing belt 11 from the transfer roller 22 to the heat-fixing portions 23, 24. The retract timing is controlled so that the photosensitive drum 18 and the fixing belt 11 are retracted from each other only for a short period of time when the end of the recording sheet 9 is input to/output from the fixing nip portion between the heating roller 23 and the pressurizing roller 24.

In FIG. 5, (e) represents the case where plural recording sheets 9 enter the fixing nip portion between the heating roller 23 and the pressurizing roller 24 at a minute interval. The photosensitive drum 18 and the fixing belt 11 are retracted from each other from the time when the trailing edge of the previous recording sheet 9 passes through the fixing nip portion to the time when the leading edge of the subsequent recording sheet 9 enters the fixing nip portion. Actually, the speed change is larger when the trailing edge of the recording sheet 9 passes through the fixing nip portion than when the leading edge of the recording sheet enters the fixing nip portion. Therefore, only when the trailing edge of the recording sheet 9 passes through the fixing nip portion, the photosensitive drum 18 and the fixing belt 11 are retracted from each other, whereby the productivity may be enhanced further.

Further, as the above-mentioned speed unevenness absorbing unit, there may be employed, for example, one structures such that the unit includes: a detection device for detecting a speed of the particle layer forming apparatus; a judging device for judging abnormality based on a detection result of the detection device; and an electromagnetic clutch placed in the driving force transmission path of the driving device for the particle layer forming apparatus, in which the driving force from the driving device for the particle layer forming apparatus is ON/OFF controlled by the electromagnetic clutch in accordance with a judgement signal from the judging device, whereby the driving force is transmitted to the particle layer forming apparatus.

Further, as the above-mentioned speed unevenness absorbing unit, there may be employed, for example, one structured such that the unit includes a clutch for braking rotation at a predetermined speed or more placed in the driving device for the particle layer forming apparatus or the heat-fixing device, thereby decreasing change in speed.

Embodiment Mode 2

Figure 6:
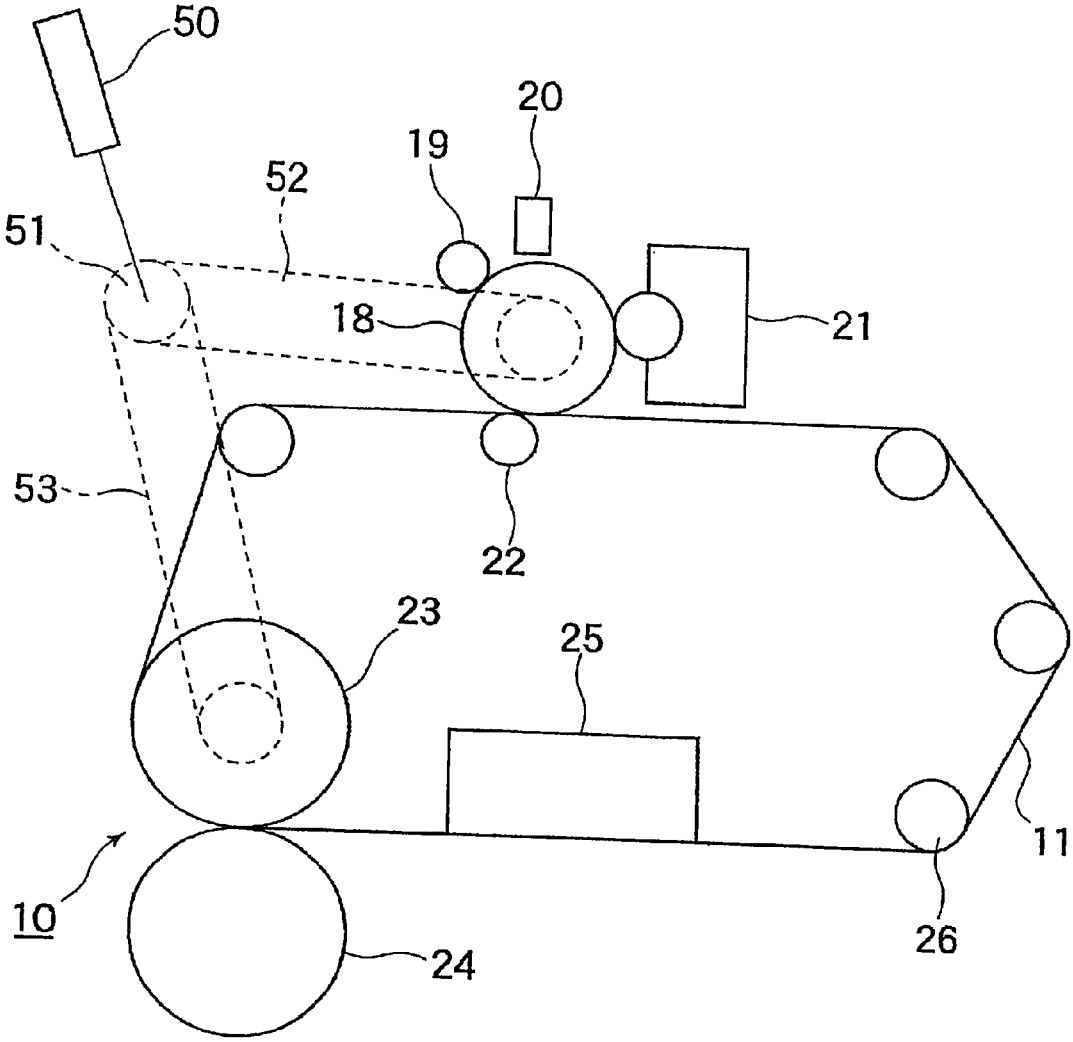
FIG. 6 is a structural view showing a transparent coat layer forming apparatus of a color image forming apparatus in accordance with Embodiment Mode 2 of the present invention.

FIG. 6 shows Embodiment Mode 2 of the present invention. The same components as those in Embodiment Mode 1 are denoted with the same reference numerals as those therein. In Embodiment Mode 2, a color image forming apparatus includes a fixing belt, an image bearing member that is rotated in contact with the fixing belt, a transfer device for transferring a transparent toner image formed on the image bearing member to the fixing belt, and a heating/pressurizing unit for heating and pressurizing a transfer material with an image transferred thereto under the condition that the transfer material is overlapped with the transparent toner image formed on the fixing belt, in which the maximum image size of the transparent toner image formed on the image bearing member is smaller than the size of the image bearing member in the axial direction and the image bearing member is always in contact with the fixing belt.

Furthermore, in Embodiment Mode 2, a portion where the image bearing member is in contact with the fixing belt is present on one side or both sides of the fixing belt.

Furthermore, in Embodiment Mode 2, the width in which the image bearing member is in contact with the fixing belt is set to be at least 8% of the width of the image bearing member in the axial direction.

FIG. 6 is a view showing a configuration of a transparent coat layer forming apparatus of the color image forming apparatus of Embodiment Mode 2.

The transparent coat layer forming apparatus has a configuration in which a photosensitive drum 18 as the image bearing member is always in contact with a fixing belt 11, as shown in FIG. 6. The photosensitive drum 18 and the fixing belt 11 are rotated by driving transmission belts 52 and 53 wound around a driving pulley 51 rotated by a driving motor 50. The driving pulley 51 is capable of selectively transmitting the driving force to either the photosensitive drum 18 or the fixing belt 11.

Figure 7:
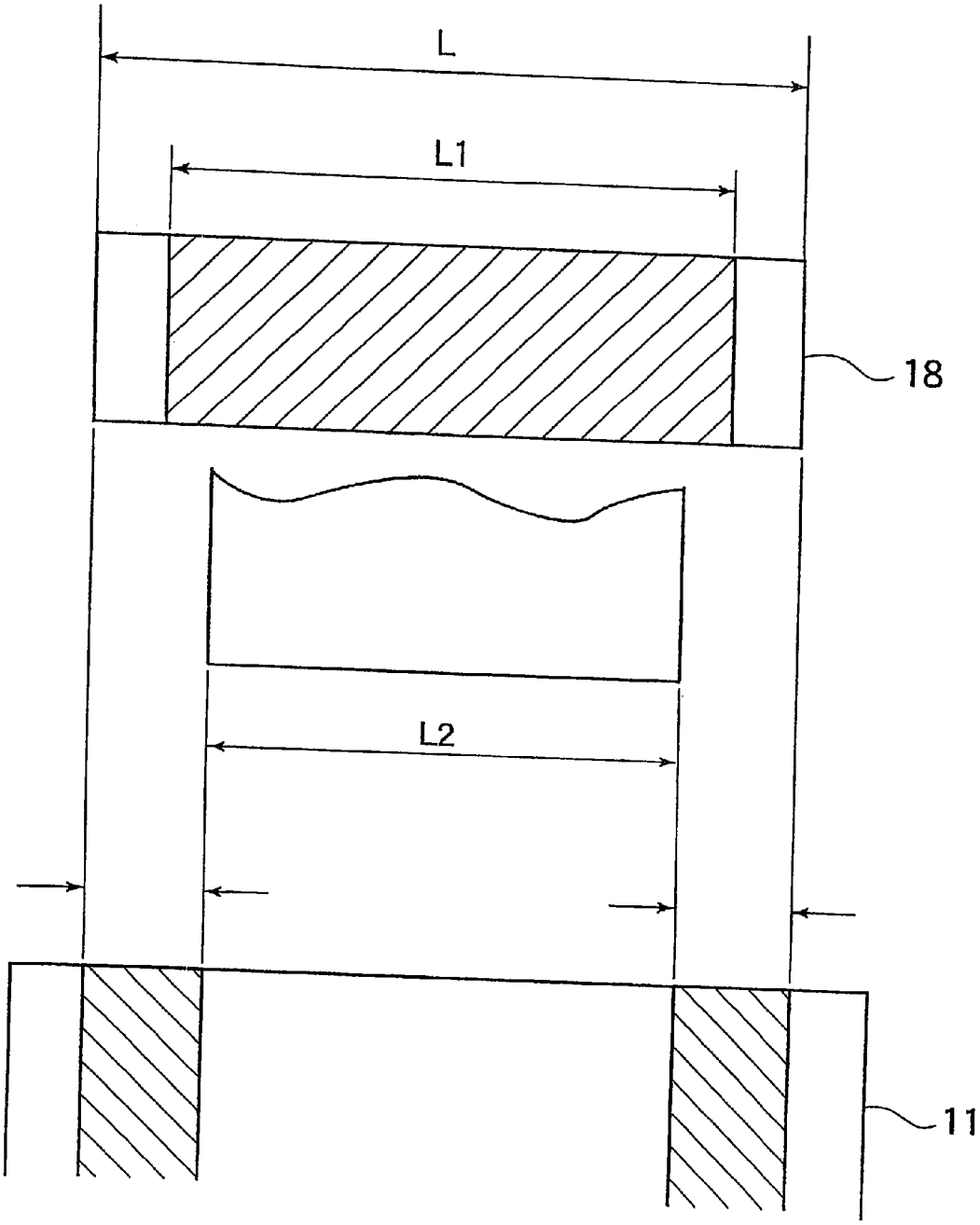
FIG. 7 is a view illustrating a state where a transparent coat layer is formed by the color image forming apparatus in accordance with Embodiment Mode 2 of the present invention.
Figure 9:
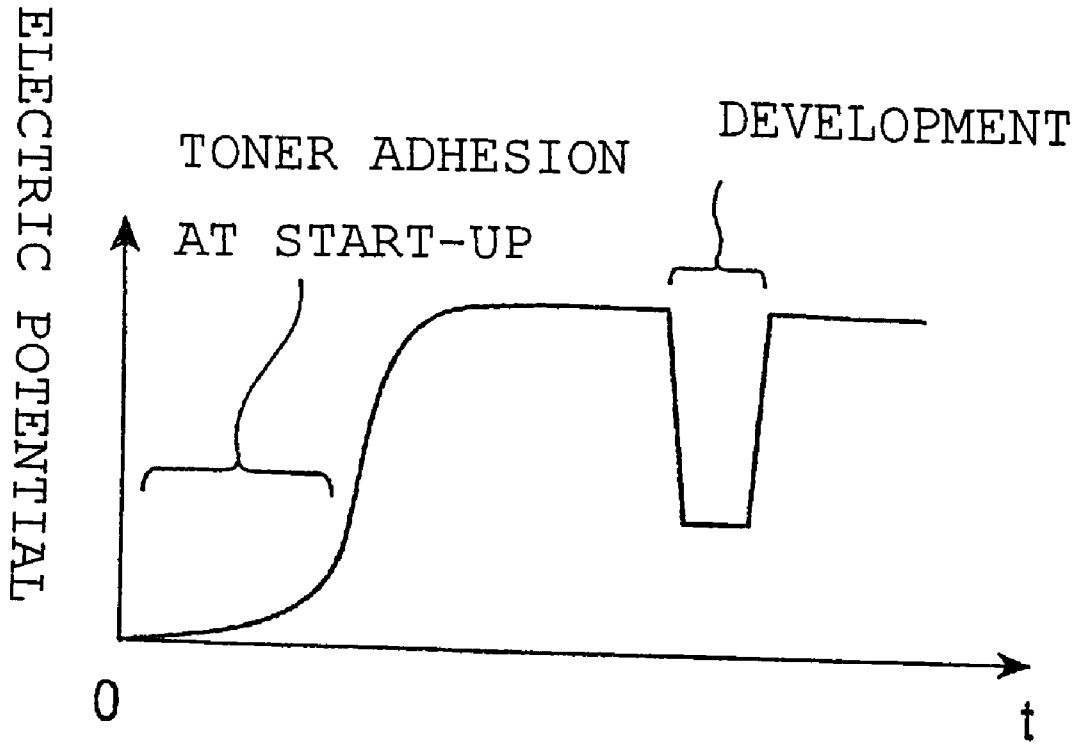
FIG. 9 is a graph illustrating the cause of contamination of a conventional fixing belt.
Figure 10:
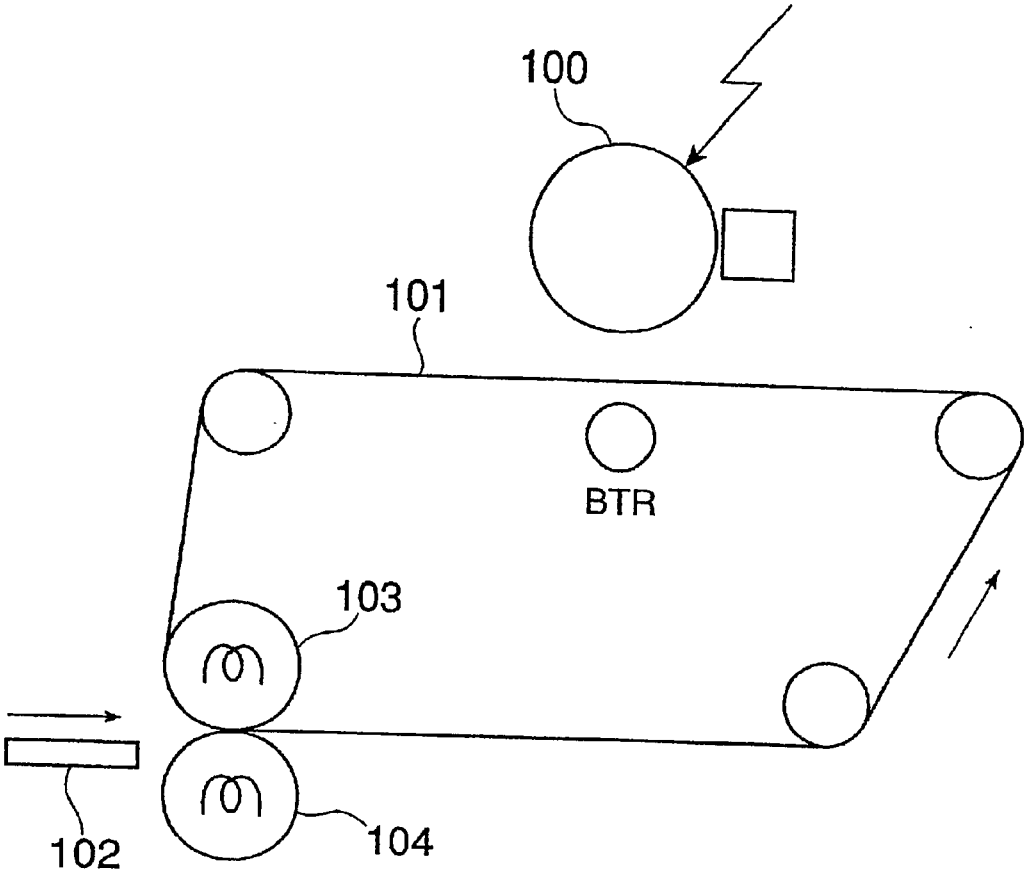
FIG. 10 is a structural view showing a transparent coat layer forming apparatus.
Figure 11:
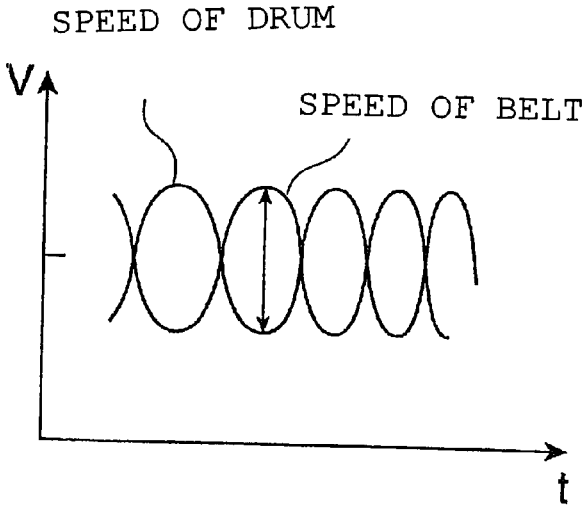
FIG. 11 is a graph showing a difference in speed between a fixing belt and a photosensitive drum in the transparent coat layer forming apparatus.
Figure 12:
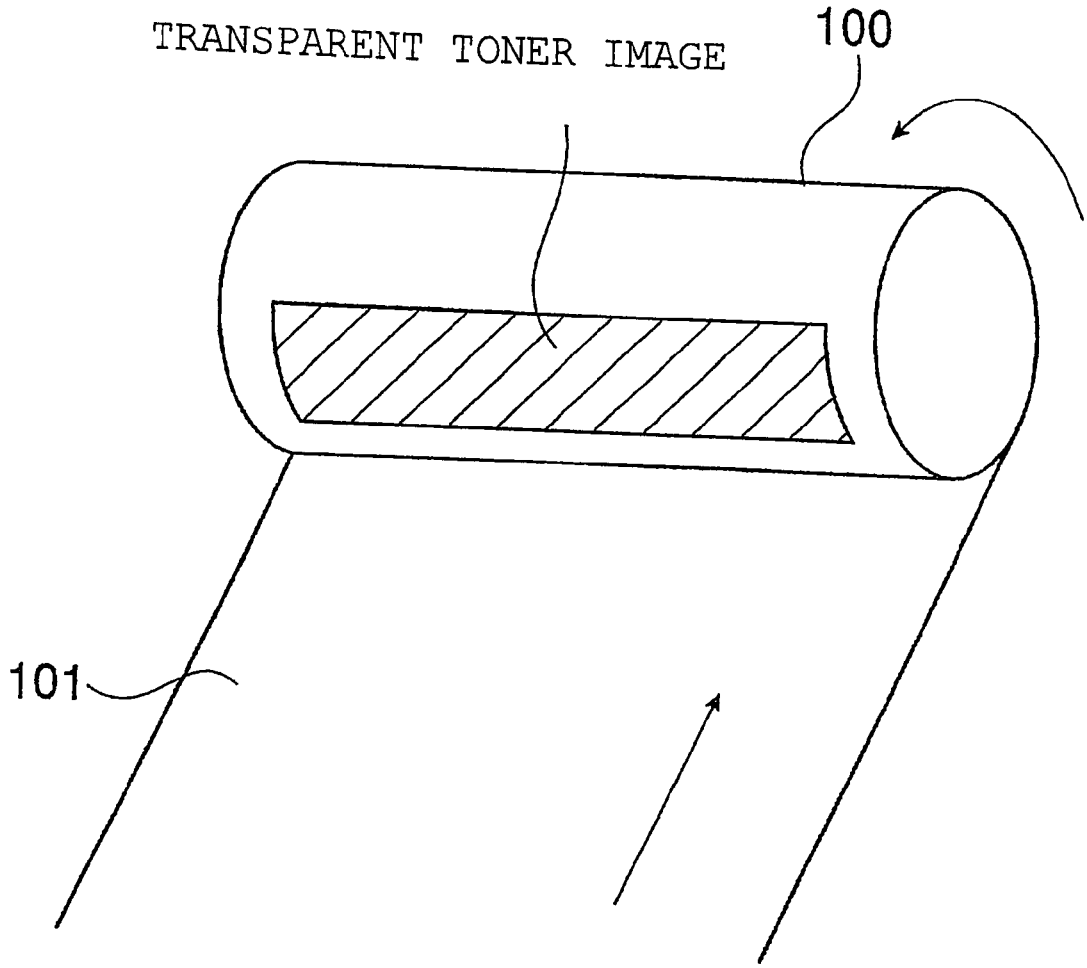
FIG. 12 is a view illustrating slip of the photosensitive drum in the transparent coat layer forming apparatus.

Furthermore, in the transparent coat layer forming apparatus, a photosensitive layer 18*a* is formed over a length L1 (e.g., 327 mm) of a total length L (e.g., 350 mm) of the photosensitive drum 18 in the axial direction, as shown in FIG. 7. Furthermore, the photosensitive drum 18 is configured so as to be in contact with the fixing belt 11 over the total length L. Furthermore, the color image forming apparatus 1 is capable of forming a color image on sheets of A3 size (297 mm) and 12.8 inches (320 mm), and a maximum image size L2 is 320 mm. Therefore, even in the case where a transparent toner image corresponding to the maximum image size L2 is formed, both ends of the photosensitive drum 18 are always in contact with the fixing belt 11, so that the driving force is exactly transmitted from the fixing belt 11.

Thus, in the photosensitive drum 18, a region obtained by excluding the maximum image size L2 from the total length L (L −L2=350−320=30 mm), that is, an 8% or more (30/350=8.5%) region is always in contact with the fixing belt 11.

As a result, even in the case where a transparent toner image corresponding to the maximum image size L2 is formed on the photosensitive drum 18, both ends of the photosensitive drum 18 are always in contact with the fixing belt 11. Consequently, even when the photosensitive drum 18 is allowed to follow the fixing belt 11, the driving force can be exactly transmitted.

In the embodiment mode shown in the figure, the portion where the photosensitive drum 18 is in contact with the fixing belt 11 is present on both sides of the fixing belt 11. However, the portion may be present only on one side of the fixing belt 11.

Embodiments

Hereinafter, the present invention will be described by way of specific embodiments with reference to the drawings. It should be appreciated that the present invention is not limited by the examples.

Embodiment 1

FIG. 2 is a view showing a configuration showing a transparent coat layer forming apparatus provided with a particle layer forming apparatus 12 (thermoplastic particle layer forming apparatus) of Embodiment 1 according to the present invention.

As the particle layer forming apparatus 12, a thermoplastic particle layer forming apparatus is selected, which includes a photosensitive drum 18, a charging device 19 opposed to the photosensitive drum 18, an exposure device 20, a particle layer developing device 21 for developing a particle layer having thermoplasticity, and a transfer roller 22 for transfer from the photosensitive drum 18 to the fixing belt 11. As the particle layer developing device 21, a one-component developing unit of non-contact type is used. The particle layer developing device 21 negatively charged a particle layer by nipping between a semicondutive developing roller and a blade of silicon rubber. AC and DC biases overlapped with each other are applied to the developing roller of the particle layer developing device 21. Furthermore, the development amount of a particle layer in a non-image portion without colored toner is set to be 1.0 (mg/cm$^2$).

As the biding resin of transparent toner, linear polyester obtained from telephthalic acid/bisphenol A ethylene oxide adduct/cyclohexanedimethanol (molar ratio=5:4:1, glass transition temperature Tg=62° C., number-average molecular weight Mn=4500, weight-average molecular weight Mw=10000) is used. The biding resin is ground by a jet mill, and then, is classified by an air classifier, whereby transparent fine particles of d50=11 $\mu$m are produced. Then, the following two kinds of inorganic fine particles A and B are allowed to adhere to 100 parts by weight of the transparent fine particles by a high-speed mixer. As the inorganic fine particles A, $SiO_2$ (surface is made hydrophobic by a silane coupling agent; average particle size: 0.05 $\mu$m; and adding amount: 1.0 part by weight) is used. As the inorganic fine particles B, $TiO_2$ (surface is made hydrophobic by a silane coupling agent; average particle size: 0.02 $\mu$m; refractive index: 2.5; and adding amount: 1.0 part by weight) is used.

As the color image forming apparatus 1, the image forming apparatus configured as shown in FIG. 1 is used. The detailed condition will be described below.

As colored toner developers used in Embodiment 1 and the following other examples, a cyan developer, amagenta developer, a yellow developer, and a black developer for A-Color produced by Fuji Zerox Co., Ltd. are used. The average particle size of the colored toner is 7 $\mu$m.

Furthermore, as a transfer material for producing a color image, OK Special Art paper (produced by Shin Oji Seishi Co., Ltd.) is used.

The weight of colored toner to be developed is set to be 0.5 (mg/cm$^2$) in a portion of an image signal Cin:100% in each color. Data read by a scanner is subjected to color, gray-scale, and sharpness correction by the image processing device, whereby an image signal of colored toner of each color is produced.

As an intermediate transfer member 8, a belt made of polyimide resin with conductive carbon particles dispersed therein is used. The half-life thereof is 0.1 seconds. The charge potential thereof is −500 V.

Moreover, in Embodiment 1, as shown in FIG. 2, a retract mechanism 34 for retracting the fixing belt 11 from the photosensitive drum 18 is merely provided. When a particle layer is not formed, the particle layer forming apparatus 12 is retracted from the fixing belt 11. Thus, a particle layer is prevented from adhering to the contact portion between the particle layer forming apparatus 12 and the fixing belt 11 at start-up of an apparatus, and the fixing belt 11 can be kept clean. Furthermore, the fixing belt 11 is allowed to be in close contact with the photosensitive drum 18 by the guide roller 29 that is driven simultaneously with the transfer roller 22, whereby it is possible to obtain stable transfer of a particle layer and a driving force when the particle layer forming apparatus 12 follows a belt.

Embodiment 2

Embodiment 2 will be described, omitting the description of the same components as those in Embodiment 1.

In Embodiment 2, in the same way as in Embodiment 1, when a particle layer is not formed, the particle layer forming apparatus 12 is retracted from the fixing belt 11, and the particle layer forming apparatus 12 and the fixing belt 11 are retracted from each other when the end of the recording sheet 9 passes through the fixing nip portion between the heating roller 23 and the pressurizing roller 24.

In FIG. 5, (e) represents a change in traveling speed of the fixing belt 11, showing that the speed in the upper direction is accelerated, and the speed in the lower direction is decelerated. When the recording sheet 9 enters the fixing nip portion between the heating roller 23 and the pressurizing roller 24, the traveling speed of the fixing belt 11 is decelerated so that the heating roller 23 and the pressurizing roller 24 are rotated over the recording sheet 9. When the end of the recording sheet 9 is discharged from the fixing nip portion, the traveling speed of the fixing belt 11 is accelerated. In an apparatus for forming a particle layer on the fixing belt 11, when the traveling speed of the fixing belt 11 is changed while the particle layer forming apparatus 12 is forming a particle layer on the fixing belt 11, the particle layer is caused to extend/shrink. However, when the end of the recording sheet 9 is input to/output from the fixing nip portion, the photosensitive drum 18 is prevented from receiving a speed change of the fixing belt 11 by retracting the photosensitive drum 18 under control from the fixing belt 11 (after retracting them from each other, bring them into contact with each other again). As a result, a particle layer can be uniformly formed in a continuous manner.

Note that, while the photosensitive drum 18 is retracted from the fixing belt 11, the photosensitive drum 18 is rotated by the driving device 28.

Embodiment 3

Embodiment 3 will be described, omitting the description of the same components as those in Embodiment 1.

In Embodiment 3, a switch-selection mechanism is provided, which selects a driving device for either a particle layer forming apparatus or a heat-fixing device by switching, at least while a particle layer is being formed on a fixing belt by the particle layer forming apparatus.

In Embodiment 3, the particle layer forming apparatus and the heat-fixing device are driven by the same driving device when the driving device for either the particle layer forming apparatus or the heat-fixing device is selected by switching. In this case, as the same driving device for driving the particle layer forming apparatus and the heat-fixing device, the driving device for the heat-fixing device is used.

Furthermore, in Embodiment 3, when the driving device for the heat-fixing device is used as the same driving device for driving the particle layer forming apparatus and the heat-fixing device, the driving force from the fixing belt of the heat-fixing device is transmitted to the photosensitive drum of the particle layer forming apparatus.

Furthermore, in Embodiment 3, the photosensitive drum of the particle layer forming apparatus is allowed to follow the fixing belt of the heat-fixing device.

Furthermore, in Embodiment 3, as a unit for transmitting the driving force from the fixing belt of the heat-fixing device to the photosensitive drum of the particle layer forming apparatus, a contact portion where the fixing belt of the heat-fixing device is in contact with the photosensitive drum of the particle layer forming apparatus, or a tracking member interposed therebetween is used. Note that in Embodiment 3, as a unit for transmitting a driving force, the contact portion between the fixing belt of the heat-fixing device and the photosensitive drum of the particle layer forming apparatus is used.

As described in the prior art section, the prior art has a problem that the fixing belt is subjected to stick-slip due to the difference in driving speed between the belt driving device and the transparent resin layer forming apparatus, with the result that a transparent resin layer cannot be formed stably. In contrast, according to the present example, while a transparent toner image is being formed, the driving device for a photosensitive member for forming a transparent toner image is shut off in such a manner that the photosensitive member receives a driving force through the contact portion with respect to the fixing belt so as to use the same driving source as that of the fixing belt, whereby the difference in speed is prevented from occurring between the fixing belt and the photosensitive drum. This can decrease stick-slip caused by the difference in speed, and thus a transparent toner image can be formed uniformly.

Embodiment 4

Embodiment 4 will be described, omitting the description of the same components as those in Embodiment 1.

In Embodiment 4, there is provided a unit for absorbing a speed unevenness of the heat-fixing device and the particle layer forming apparatus, or the heat-fixing device or the particle layer forming apparatus.

As the speed unevenness absorbing unit, a one-way gear, which is rotated in one direction without a load and locked in the other direction, is placed in a driving force transmission path of the driving device for the particle layer forming apparatus. The one-way gear drives the driving device for the particle layer forming apparatus at a speed slightly lower than that of the fixing belt of the heat-fixing device. The one-way gear is usually rotated freely without a load, whereby the particle layer forming apparatus follows the fixing belt. However, when the speed of the particle layer forming apparatus is decreased (in an abnormal state), the one-way gear is locked so that the driving force is transmitted from the driving device to the particle layer forming apparatus.

The speed unevenness of the fixing belt and the speed unevenness (slip caused by a change in contact area between the photosensitive drum and the fixing belt depending upon the image size of a transparent toner image) of the photosensitive drum caused by allowing the photosensitive drum to follow the fixing belt are suppressed by providing the speed unevenness absorbing unit for absorbing a speed unevenness in addition to the configuration of Embodiment 3 as follows:

(1) When the photosensitive drum 18 slips with respect to the fixing belt 11, the driving source is switched to the driving force of the driving device by the one-way gear 33 that also functions as the speed unevenness absorbing unit, whereby the driving force of the driving device is given to the photosensitive drum. Thus, the elongation of an image is decreased (Example 4-1).

(2) When the photosensitive drum 18 slips with respect to the fixing belt 11, the driving source is switched to the driving force of the driving device 28 by an electromagnetic clutch (which also functions as the above-mentioned speed unevenness absorbing unit), in accordance with signals from a detection device such as an encoder for detecting the rotation speed of the photosensitive drum 18 used in place of the one-way gear and the judging device for judging whether or not the rotation speed of the photosensitive drum 18 is appropriate based on the detection result of the detection device. The driving force of the driving device 28 is given to the photosensitive member, whereby elongation of an image is decreased (Embodiment 4-2).

(3) Furthermore, in the case where the fixing belt is accelerated when a recording sheet is discharged from the fixing nip portion, a torque limiter provided in the driving force transmission part of the driving device 28 provides brake to the driving device, in place of the one way gear, whereby elongation of an image is decreased (Embodiment 4-3).

Embodiment 5

Embodiment 5 will be described, omitting the description of the same components as those in Embodiment 1.

In Embodiment 5, the controls in Embodiments 1 and 2 are performed in the configuration adopting a one-way gear as the speed unevenness absorbing unit in Embodiment 4. During the retract operation and when the photosensitive drum is in contact with the fixing belt, the one-way gear is operated in conjunction therewith. Therefore, the complicated driving force transmission path of the driving device caused by switching of a driving force is simplified by using the one-way gear. In addition, the stick-slip and the slip of the photosensitive drum due to the change and the difference in speed of the ends of the recording sheet 9 can be effectively suppressed.

Comparative Example 1

A conventional coat layer forming apparatus without a retract mechanism is used, in which the fixing belt and the photosensitive drum are driven by separate driving devices. (Evaluation)

Regarding four items: adhesion of the fixing belt to an image due to the contamination of the fixing belt, large elongation/shrinkage by the ends of a recording sheet, disturbance of an image due to the high frequency caused by the stick-slip, and disturbance of an image due to the low frequency caused by the slip of the photosensitive drum, a sample image of a photograph of a person is created, and functional evaluation is conducted visually. Evaluation on a scale of 1 to 5 is performed by 20 evaluators.

1. Very bad
2. Bad
3. Fair
4. Good
5. Very good

Next, an average value of the above evaluation is obtained, and evaluation is performed based on the following criterion.

X . . . average value is less than 2.

Δ. . . average value is 2 to 4 (excluding 4).

602 . . . average value is 4 or more

FIG. 8 shows the results of the above evaluation.

The following is apparent from FIG. 8. In the case of Embodiment 1, the retract mechanism 34 for retracting the fixing belt 11 from the photosensitive drum 18 is merely provided. Therefore, even in the case where transparent toner adheres to the surface of the photosensitive drum 18 at start-up of the photosensitive drum 18, since the photosensitive drum 18 has been retracted from the fixing belt 11 before the transfer material 9 enters the fixing nip portion, the belt is prevented from being contaminated. However, no countermeasures are taken for the timing control of the retract mechanism 34, the driving of the photosensitive drum 18 and the fixing belt 11 at the same speed, and the absorption of a speed unevenness. Therefore, change in speed due to the ends of a recording sheet, stick-slip, and slip of the photosensitive drum occur.

Furthermore, in the case of Embodiment 2, the retract mechanism 34 for retracting the fixing belt 11 from the photosensitive drum 18 is provided, and the retract control is performed when the recording sheet 9 passes through the fixing nip portion. Therefore, the change in speed due to the ends of the recording sheet, as well as the contamination of the fixing belt, can be prevented.

Furthermore, in the case of Embodiment 3, the photosensitive drum 18 is allowed to follow the fixing belt 11. Therefore, only the occurrence of stick slip due to the difference in driving speed between the photosensitive drum 18 and the fixing belt 11 can be prevented.

In the case of Embodiment 4-1, the photosensitive drum 18 is allowed to follow the fixing belt 11, and a one-way configuration is adopted as a speed unevenness absorbing unit. Therefore, the occurrence of slip of the photosensitive drum, as well as stick-slip, can be prevented.

Furthermore, in the case of Embodiment 4-2, the photosensitive drum 18 is allowed to follow the fixing belt 11, and an electromagnetic clutch is adopted as a speed unevenness absorbing unit. Therefore, the occurrence of slip of the photosensitive drum, as well as stick-slip, can be prevented to some degree.

Furthermore, in the case of Embodiment 4-3, the photosensitive drum 18 is allowed to follow the fixing belt 11, and a torque limiter is adopted as a speed unevenness absorbing unit. Therefore, the change in speed due to the ends of the recording sheet, as well as stick-slip, can be prevented.

Furthermore, in the case of Embodiment 5, the configurations of Embodiment 2 and Embodiment 4-1 are adopted. Therefore, the contamination of the fixing belt, the change in speed due to the ends of the recording sheet, stick-slip, and the slip of the photosensitive drum can all be prevented.

In the case of the comparative example, as described in the prior art, the contamination of the fixing belt, the change in speed due to the ends of the recording sheet, stick-slip, and the slip of the photosensitive drum all occur.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A transparent coat layer forming apparatus, comprising:

a heat-fixing device provided with a fixing belt;

a particle layer forming apparatus that forms a particle layer made of transparent toner on the fixing belt of the heat-fixing device;

plural rollers including a transfer roller which stretch a transfer region of the fixing belt to which the particle layer is transferred from the particle layer forming apparatus in a plane shape; and a retract mechanism that allows the fixing belt stretched in a plane shape by the plural rollers including the transfer roller to contact/separate from the particle layer forming apparatus, wherein the particle layer is formed on the fixing belt by the particle layer forming apparatus, and the particle layer formed on the fixing belt of the heat-fixing device is overlapped with a transfer material with an image transferred thereto in a fixing nip portion, followed by heating and pressurizing, whereby a transparent coat layer made of the particle layer is formed on the transfer material with the image transferred thereto.

2. A transparent coat layer forming apparatus according to claim 1, wherein the retract mechanism is controlled so as to retract the fixing belt from the particle layer forming apparatus at least when an end of the transfer material passes through the fixing nip portion of the heat-fixing device.

3. A transparent coat layer forming apparatus according to claim 1, wherein the particle layer forming apparatus comprises: a photosensitive drum that forms an image by a charging process, an exposure process, and a transfer process; a charging device; an exposure device; and a developing device.

4. A transparent coat layer forming apparatus according to claim 1, wherein the particle layer forming apparatus comprises a developing device that develops transparent toner that electrostatically forms a particle layer.

5. A transparent coat layer forming apparatus, comprising:

a heat-fixing device provided with a fixing belt;

a particle layer forming apparatus that forms a particle layer made of transparent toner on the fixing belt of the heat-fixing device;

plural different driving devices that drive the fixing belt of the heat-fixing device and the particle layer forming apparatus; and a switch-selection mechanism that selects one of the driving device for the particle layer forming apparatus and the driving device for the heat-fixing device by switching at least while a particle layer is being formed on the fixing belt by the particle layer forming apparatus, wherein the particle layer is formed on the fixing belt by the particle layer forming apparatus, and the particle layer formed on the fixing belt of the heat-fixing device is overlapped with a transfer material with an image transferred thereto in a fixing nip portion, followed by heating and pressurizing, whereby a transparent coat layer made of the particle layer is formed on the transfer material with the image transferred thereto.

6. A transparent coat layer forming apparatus according to claim 5, in which the driving device for the heat-fixing device which drives the fixing belt of the heat-fixing device and the driving device for the particle layer forming apparatus which drives the particle layer forming apparatus are separately provided, the transparent coat layer forming apparatus further comprising a switch-selection mechanism that switches to one of the driving device for the heat-fixing device and the driving device for the particle layer forming apparatus at least while the particle layer is being formed on the fixing belt by the particle layer forming apparatus, thereby driving the particle layer forming apparatus and the heat-fixing device with the same driving device.

7. A transparent coat layer forming apparatus according to claim 6, wherein the switch-selection mechanism switches the driving device for the particle layer forming apparatus to the driving device for the heat-fixing device so that the particle layer forming apparatus and the heat-fixing device are driven with the same driving device.

8. A transparent coat layer forming apparatus according to claim 7, wherein a unit that drives the particle layer forming apparatus and the heat-fixing device with the same driving device is a unit that transmits a driving force from the fixing belt of the heat-fixing device to the particle layer forming apparatus.

9. A transparent coat layer forming apparatus according to claim 8, wherein the particle layer forming apparatus is driven following the fixing belt.

10. A transparent coat layer forming apparatus according to claim 9, wherein the unit that transmits the driving force from the fixing belt of the heat-fixing device to the particle layer forming apparatus is composed of a contact portion between the fixing belt of the heat-fixing device and the particle layer forming apparatus or a tracking member interposed therebetween.

11. A transparent coat layer forming apparatus according to claim 10, further comprising a speed unevenness absorbing unit that absorbs a speed unevenness of at least one of the heat-fixing device and the particle layer forming apparatus.

12. A transparent coat layer forming apparatus according to claim 11, wherein the speed unevenness absorbing unit comprises a unit that is composed of a one-way gear configuration that is placed in a driving force transmission path of the driving device for the particle layer forming apparatus, is rotated in one direction without a load and locked in rotating in the other direction to transmit a rotation force, is adapted to drive the driving device for the particle layer forming apparatus at a speed slightly lower than that of the fixing belt of the heat-fixing device, is rotated freely during a normal operation without a load to thereby drive the particle layer forming apparatus following the fixing belt, and is locked to transmit the driving force from the driving device to the particle layer forming apparatus when the speed of the particle layer forming apparatus is decreased (in an abnormal state).

13. A transparent coat layer forming apparatus according to claim 11, wherein the speed unevenness absorbing unit comprises: a detection device that detects a speed of the particle layer forming apparatus; a judging device that judges abnormality based on a detection result of the detection device; and an electromagnetic clutch placed in the driving force transmission path of the driving device for the particle layer forming apparatus, wherein the driving force from the driving device for the particle layer forming apparatus is ON/OFF controlled by the electromagnetic clutch in accordance with a judgement signal from the judging device, whereby the driving force is transmitted to the particle layer forming apparatus.

14. A transparent coat layer forming apparatus according to claim 11, wherein the speed unevenness absorbing unit comprises a clutch that brakes rotation at a predetermined speed or more placed in the driving device for the particle layer forming apparatus or the heat-fixing device, thereby decreasing change in speed.

15. A transparent coat layer forming apparatus according to claim 5, comprising a retract mechanism that allows the fixing belt stretched in a plane shape by the plural driving devices including a transfer roller to contact/separate from the particle layer forming apparatus.

16. A color image forming apparatus comprising:

an image bearing member;

a colored toner developing device that forms insulating colored toner images of at least cyan, magenta, and yellow on the image bearing member;

an intermediate transfer member to which the colored toner images are transferred from the image bearing member;

a first transfer device that transfers the colored toner images from the image bearing member onto the intermediate transfer member;

a second transfer device that transfers the colored toner images on the intermediate transfer member onto a transfer material;

a heat-fixing device having a fixing belt which fixes the colored toner images on the transfer material by heating;

a particle layer forming apparatus that forms a particle layer made of transparent toner on the fixing belt of the heat-fixing device;

plural rollers including a transfer roller which stretches in a plane shape a transfer region of the fixing belt to which the particle layer is transferred from the particle layer forming apparatus; and a retract mechanism that allows the fixing belt stretched in a plane shape by the plural rollers including the transfer roller to contact/separate from the particle layer forming apparatus, wherein the particle layer is formed on the fixing belt by the particle layer forming apparatus, and the particle layer formed on the fixing belt of the heat-fixing device is overlapped with a transfer material with the colored toner images transferred thereto, followed by heating and pressurizing, whereby a transparent coat layer made of the particle layer is formed on the transfer material with the colored toner images transferred thereto, and at this time, the particle layer forming apparatus and the fixing belt of the heat-fixing device are driven according to claim 5.

17. A color image forming apparatus comprising a heat-fixing device that comprises:

a fixing belt;

an image bearing member that is rotated in contact with the fixing belt;

a developing device that develops a transparent toner image on the image bearing member;

a transfer device that transfers the transparent toner image formed on the image bearing member onto the fixing belt; and a heating/pressuring unit that heats and pressurizes the transparent toner image formed on the fixing belt and the transfer material with an image transferred thereto under a condition that the transparent toner image is overlapped with the transfer material, wherein a maximum image size of the transparent toner image formed on the image bearing member is smaller than a size of the image bearing member in an axial direction, and the image bearing member is always in contact with the fixing belt.

18. A color image forming apparatus according to claim 17, wherein a contact portion between the image bearing member and the fixing belt is placed on one side or both sides of the fixing belt.

19. A color image forming apparatus according to claim 17, wherein a width with which the image bearing member is in contact with the fixing belt is at least 8% of a width of the image bearing member in an axial direction.

* * * * *